US006210053B1

(12) United States Patent
Suzuki et al.

(10) Patent No.: US 6,210,053 B1
(45) Date of Patent: Apr. 3, 2001

(54) IMAGE-FORMING APPARATUS WITH A THERMAL HEAD INCLUDING AN ARCUATE BIMETAL ELEMENT

(75) Inventors: Minoru Suzuki, Tochigi; Hiroshi Orita; Hiroyuki Saito, both of Saitama; Katsuyoshi Suzuki; Koichi Furusawa, both of Tokyo, all of (JP)

(73) Assignee: Asahi Kogaku Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/227,264

(22) Filed: Jan. 8, 1999

(30) Foreign Application Priority Data

Jan. 9, 1998 (JP) ..... 10-015139

(51) Int. Cl.[7] ..... B41J 2/325; B41J 2/335; B41J 2/345

(52) U.S. Cl. ..... 400/120.01; 400/120.04; 400/120.02; 400/241.2; 347/176

(58) Field of Search ..... 400/120.01, 118.2, 400/237, 241.2, 120.02, 120.04; 347/176, 200

(56) References Cited

U.S. PATENT DOCUMENTS 3,622,815 * 11/1971 Schafft ..... 310/332
4,399,209 8/1983 Sanders et al. .
4,440,846 4/1984 Sanders et al. .
4,613,241 * 9/1986 Kitagawa ..... 400/121
4,644,376 2/1987 Usami et al. .
4,871,271 * 10/1989 Watanabe et al. ..... 400/124

FOREIGN PATENT DOCUMENTS 4-4960 1/1992 (JP) .

* cited by examiner

*Primary Examiner*—Daniel J. Colilla
(74) *Attorney, Agent, or Firm*—Greenblum & Bernstein, P.L.C.

(57) ABSTRACT

In an image-forming system, an image-forming substrate is used that includes a paper sheet, and a microcapsule layer, coated over the paper sheet, which contains at least one type of microcapsule filled with a dye. Each microcapsule exhibits a characteristic such that, when a microcapsule is compacted under a given pressure at a given temperature, the dye seeps from the compacted microcapsule. A pressure/temperature applicator includes a roller platen, a thermal head having at least one arcuate bimetal element associated with the platen such that the substrate can be interposed between the platen and the thermal head, and an electrical energization system that electrically heats the arcuate bimetal element in accordance with image-information data. A degree of protrusion of the arcuate bimetal element varies in accordance with the electrical heating of the arcuate bimetal element such that a squashed pressure, to be exerted on the platen by the arcuate bimetal element, substantially equals the pressure exerted by the arcuate bimetal element when heated to the given temperature.

15 Claims, 18 Drawing Sheets

FIG. 23

TABLE

| IMAGE-PIXEL SIGNALS (CS, MS, YS) | CONTROL SIGNALS (DA) |
|---|---|
| CS = 1<br>MS = 0 (CYAN)<br>YS = 0 | HLP1 |
| CS = 1<br>MS = 1 (BLUE)<br>YS = 0 | HLP2 |
| CS = 0<br>MS = 1 (MAGENTA)<br>YS = 0 | HLP3 |
| CS = 0<br>MS = 1 (RED)<br>YS = 1 | HLP4 |
| CS = 0<br>MS = 0 (YEWWLO)<br>YS = 1 | HLP5 |
| CS = 1<br>MS = 0 (GREEN)<br>YS = 1 | HLP6 |
| CS = 1<br>MS = 1 (BLACK)<br>YS = 1 | HLP7 |
| CS = 0<br>MS = 0 (WHITE)<br>YS = 0 | (LOW) |

IMAGE-FORMING APPARATUS WITH A THERMAL HEAD INCLUDING AN ARCUATE BIMETAL ELEMENT

BACKGROUND OF THE INVENTION

1. Field of the Invention

The present invention relates to an image-forming system for forming an image on an image-forming substrate, coated with a layer of microcapsules filled with dye or ink, by selectively squashing and breaking the microcapsules in the layer of microcapsules. Further, the present invention relates to an image-forming apparatus, which forms an image on the image-forming substrate, used in the image-forming system.

2. Description of the Related Art

An image-forming system per se is known, and uses an image-forming substrate coated with a layer of microcapsules filled with dye or ink, on which an image is formed by selectively squashing and breaking microcapsules in the layer of microcapsules.

For example, in a conventional image-forming system using an image-forming substrate coated with a layer of microcapsules in which a shell of each microcapsule is formed from a photo-setting resin, an optical image is formed as a latent image on the layer of microcapsules by exposing it to light rays in accordance with a series of digital image-pixel signals. Then, the latent image is developed by exerting a pressure on the layer of microcapsules. Namely, the microcapsules, which are not exposed to the light rays, are squashed and broken, whereby dye or ink seeps out of the broken and squashed microcapsules, and thus the latent image is visually developed by the seepage of the dye or ink.

Of course, in this conventional image-forming system, each of the image-forming substrates must be packed so as to be protected from being exposed to light, resulting in wastage of materials. Further, the image-forming substrates must be carefully handled such that they are not subjected to excess pressure due to the softness of unexposed microcapsules, resulting in an undesired seepage of the dye or ink.

Also, a color-image-forming system, using an image-forming substrate coated with a layer of microcapsules filled with different color dyes or inks, is known. In this system, the respective different colors are selectively developed on an image-forming substrate by applying specific temperatures to the layer of color microcapsules. Nevertheless, it is necessary to fix a developed color by irradiation, using a light of a specific wavelength. Accordingly, this color-image-forming system is costly, because an additional irradiation apparatus for the fixing of a developed color is needed, and electric power consumption is increased due to the additional irradiation apparatus. Also, since a heating process for the color development and an irradiation process for the fixing of a developed color must be carried out with respect to each color, this hinders a quick formation of a color image on the color-image-forming substrate.

SUMMARY OF THE INVENTION

Therefore, an object of the present invention is to provide an image-forming system, using an image-forming substrate coated with a layer of microcapsules filled with dye or ink, in which an image can be quickly formed on the image-forming substrate at a low cost and without producing a large amount of waste material.

Another object of the present invention is to provide an image-forming apparatus used in the image-forming system.

In accordance with an aspect of the present invention, there is provided an image-forming system comprising an image-forming substrate that includes a base member, and a layer of microcapsules, coated over the base member, containing at least one type of microcapsule filled with a dye. The at least one type microcapsule exhibits a pressure/temperature characteristic such that, when each of the microcapsules is squashed and broken under a predetermined pressure at a predetermined temperature, the dye seeps from the squashed and broken microcapsule. The image-forming system further comprises a pressure/temperature application unit that includes a platen member, a thermal head assembly having at least one arcuate bimetal element associated with the platen member such that the image-forming substrate is interposeable between the platen member and the thermal head assembly, and an electrical energization system that electrically heats the at lease one arcuate bimetal element in accordance with image-information data, a degree of protrusion of the at least one arcuate bimetal element varying in accordance with the electrical heating of the at least one arcuate bimetal element such that a pressure, exerted on the platen member by the at least one arcuate bimetal element, substantially equals the predetermined pressure when the at least one arcuate bimetal element is heated to the predetermined temperature.

In accordance with another aspect of the present invention, there is provided an image-forming system comprising an image-forming substrate that includes a base member, and a layer of microcapsules, coated over said base member, containing at least two types of microcapsule: a first type of microcapsule filled with a first dye and a second type of microcapsule filled with a second dye. The layer of microcapsules may contain at least two types of microcapsule: a first type of microcapsule filled with a first dye and a second type of microcapsule filled with a second dye. The first type of microcapsule exhibits a first pressure/temperature characteristic such that, when the first type of microcapsule is squashed and broken under a first predetermined pressure at a first predetermined temperature, the first dye seeps from the squashed and broken microcapsule, and the second type of microcapsule exhibits a second pressure/temperature characteristic such that, when the second type of microcapsule is squashed and broken under a second predetermined pressure at a second predetermined temperature, the second dye seeps from the squashed and broken microcapsule. The image-forming system further comprises a pressure/temperature application unit that includes a platen member, a thermal head assembly having at least one arcuate bimetal element associated with the platen member such that the image-forming substrate is interposeable between the platen member and the thermal head assembly, and an electrical energization system that electrically heats the at least one arcuate bimetal element in accordance with image-information data, a degree of protrusion of the at least one arcuate bimetal element varying in accordance with the electrical heating of the at least one arcuate bimetal element such that a pressure, exerted on the platen member by the at least one arcuate bimetal element, substantially equals one of the first and second predetermined pressures when the at least one arcuate bimetal element is heated to a corresponding one of the first and second predetermined temperatures.

Preferably, the at least one arcuate bimetal element is constituted such that the degree of protrusion of the at least one arcuate bimetal element gradually reduces as the electrical heating of the at least one arcuate bimetal element increases. Also, the thermal head assembly is movable between a first position at which the at least one arcuate bimetal element exerts substantially a negligible pressure on the platen member, and a second position at which the at least one arcuate bimetal element exerts a pressure on the platen member, the thermal head assembly being moved from the first position to the second position after the electrical heating of the at least one arcuate bimetal element to the predetermined temperature.

The thermal head assembly may have a plurality of arcuate bimetal elements aligned with each other in a single array, and the platen member may be formed as a rotatable roller platen arranged in parallel to the single array of arcuate bimetal elements. In this case, the plurality of arcuate bimetal elements is selectively and electrically heated by the electrical energization system in accordance with a single-line of the image-information data.

In accordance with yet another aspect of the present invention, there is provided an image-forming apparatus that forms an image on an image-forming substrate that includes a base member, and a layer of microcapsules, coated over the base member, that contains at least one type of microcapsule filled with a dye, the at least one type of microcapsule exhibiting a pressure/temperature characteristic such that, when the at least one type of microcapsule is squashed and broken under a predetermined pressure at a predetermined temperature, the dye seeps from the squashed and broken microcapsule. The image-forming apparatus comprises: a platen member; a thermal head assembly having at least one arcuate bimetal element and associated with the platen member such that the image-forming substrate is interposeable between the platen member and the thermal head assembly; and an electrical energization system that electrically heats the at least one arcuate bimetal element in accordance with image-information data, a degree of protrusion of the at least one arcuate bimetal element varying in accordance with the electrical heating of the at least one arcuate bimetal element such that a pressure, exerted on the platen member by the at least one arcuate bimetal element, substantially equals the predetermined pressure when the at least one arcuate bimetal element is heated to the predetermined temperature.

BRIEF DESCRIPTION OF THE DRAWINGS

These object and other objects of the present invention will be better understood from the following description, with reference to the accompanying drawings in which:

FIG. 23 is a table showing a relationship between three-primary color digital image-pixel signals and a control signal, the control signal being produced as one of seven types of high-level pulses in accordance with a combination of the color digital image-pixel signals.

DESCRIPTION OF THE PREFERRED EMBODIMENTS

Figure 1:
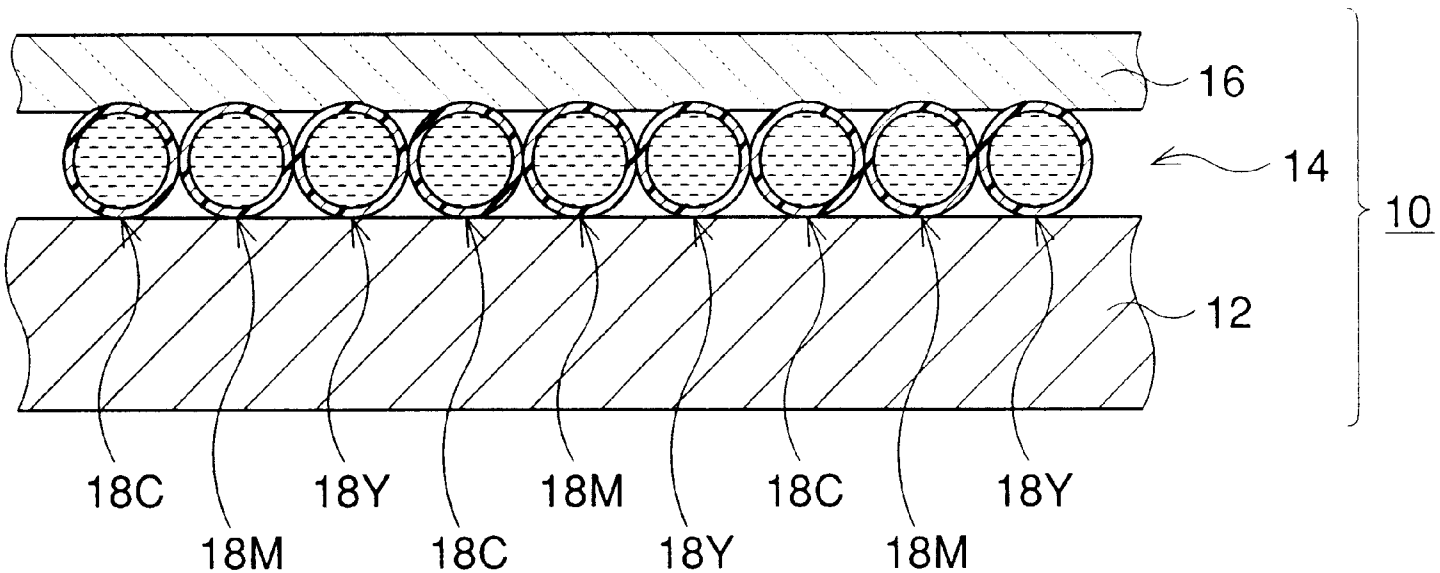
FIG. 1 is a schematic conceptual cross-sectional view showing an image-forming substrate, comprising a layer of microcapsules including a first type of cyan microcapsules filled with a cyan dye, a second type of magenta microcapsules filled with a magenta dye and a third type of yellow microcapsules filled with a yellow dye, used in a first embodiment of an image-forming system according to the present invention.

FIG. 1 shows an image-forming substrate, generally indicated by reference 10, which is used in a first embodiment of an image-forming system according to the present invention. The image-forming substrate 10 is produced in a form of a paper sheet. Namely, the image-forming substrate or sheet 10 comprises a sheet of paper 12, a layer of microcapsules 14 coated over a surface of the paper sheet 12, and a sheet of protective transparent film 16 covering the microcapsule layer 14.

The microcapsule layer 14 is formed from three types of microcapsules: a first type of microcapsules 18C filled with cyan liquid dye or ink, a second type of microcapsules 18M filled with magenta liquid dye or ink, and a third type of microcapsules 18Y filled with yellow liquid dye or ink, and these microcapsules 18C, 18M and 18Y are uniformly distributed in the microcapsule layer 14. In each type of microcapsule (18C, 18M, 18Y), a shell wall of a microcapsule is formed of a synthetic resin material, usually colored white. Also, each type of microcapsule (18C, 18M, 18Y) may be produced by a well-known polymerization method, such as interfacial polymerization, in-situ polymerization or the like, and may have an average diameter of several microns, for example, 5 $\mu$m to 10 $\mu$m.

Note, when the paper sheet 12 is colored with a single color pigment, the resin material of the microcapsules 18C, 18M and 18Y may be colored by the same single color pigment.

For the uniform formation of the microcapsule layer 14, for example, the same amounts of cyan, magenta and yellow microcapsules 18C, 18M and 18Y are homogeneously mixed with a suitable binder solution to form a suspension, and the paper sheet 12 is coated with the binder solution, containing the suspension of microcapsules 18C, 18M and 18Y, by using an atomizer.

Note, in FIG. 1, for the convenience of illustration, although the microcapsule layer 14 is shown as having a thickness corresponding to the diameter of the microcapsules 18C, 18M and 18Y, in reality, the three types of microcapsules 18C, 18M and 18Y overlay each other, and thus the microcapsule layer 14 has a larger thickness than the diameter of a single microcapsule 18C, 18M or 18Y.

In the embodiment of the image-forming sheet 10 shown in FIG. 1, for the resin material of each type of microcapsule (18C, 18M, 18Y), a shape memory resin is utilized. As is well known, for example, the shape memory resin is represented by a polyurethane-based-resin, such as polynorbornene, trans-1, 4-polyisoprene polyurethane. As other types of shape memory resin, a polyimide-based resin, a polyamide-based resin, a polyvinyl-chloride-based resin, a polyester-based resin and so on are also known.

Figure 2:
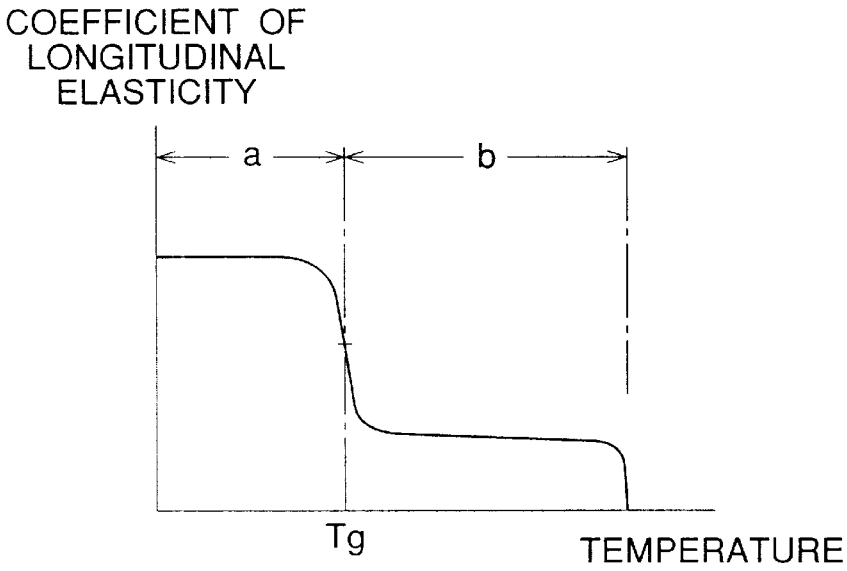
FIG. 2 is a graph showing a characteristic curve of a longitudinal elasticity coefficient of a shape memory resin.

In general, as is apparent from a graph of FIG. 2, the shape memory resin exhibits a coefficient of longitudinal elasticity, which abruptly changes at a glass-transition temperature boundary $T_g$. In the shape memory resin, Brownian movement of the molecular chains is stopped in a low-temperature area "a", which is less than the glass-transition temperature $T_g$, and thus the shape memory resin exhibits a glass-like phase. On the other hand, Brownian movement of the molecular chains becomes increasingly energetic in a high-temperature area "b", which is higher than the glass-transition temperature $T_g$, and thus the shape memory resin exhibits a rubber elasticity.

The shape memory resin is named due to the following shape memory characteristic: after a mass of the shape memory resin is worked into a shaped article in the low-temperature area "a", when such a shaped article is heated over the glass-transition temperature $T_g$, the article becomes freely deformable. After the shaped article is deformed into another shape, when the deformed article is cooled to below the glass-transition temperature $T_g$, the other shape of the article is fixed and maintained. Nevertheless, when the deformed article is again heated to above the glass-transition temperature $T_g$, without being subjected to any load or external force, the deformed article returns to the original shape.

In the image-forming sheet 10, the shape memory characteristic per se is not utilized, but the characteristic abrupt change of the shape memory resin in the longitudinal elasticity coefficient is utilized, such that the three types of microcapsules 18C, 18M and 18Y can be selectively broken and squashed at different temperatures and under different pressures, respectively.

Figure 3:
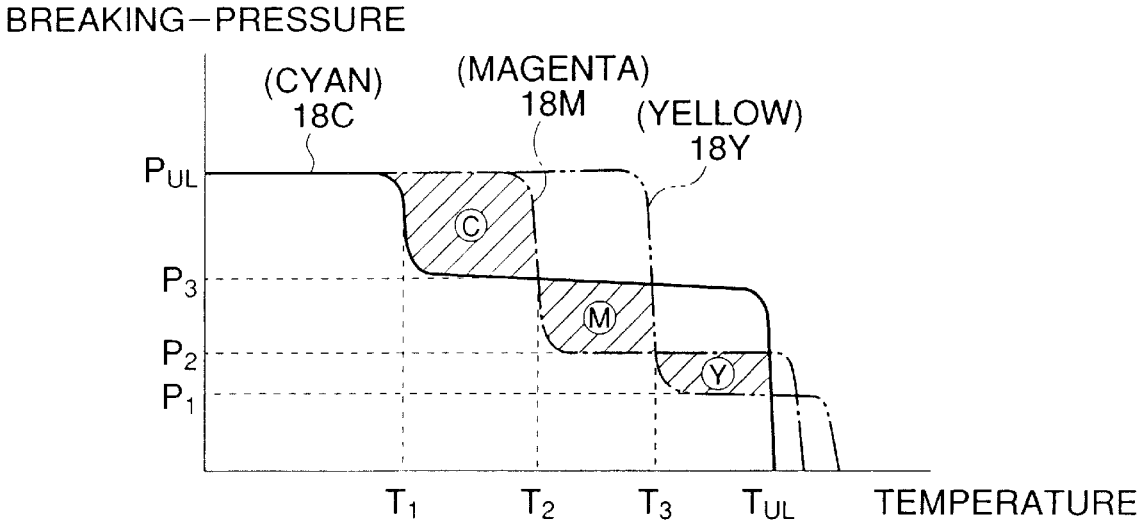
FIG. 3 is a graph showing pressure/temperature breaking characteristics of the respective cyan, magenta and yellow microcapsules shown in FIG. 1, with each of a cyan-developing area, a magenta-developing area and a yellow-developing area being indicated as a hatched area.

As shown in a graph of FIG. 3, a shape memory resin of the cyan microcapsules 18C is prepared so as to exhibit a characteristic longitudinal elasticity coefficient, indicated by a solid line, having a glass-transition temperature $T_1$; a shape memory resin of the magenta microcapsules 18M is prepared so as to exhibit a characteristic longitudinal elasticity coefficient, indicated by a single-chained line, having a glass-transition temperature $T_2$; and a shape memory resin of the yellow microcapsules 18Y is prepared so as to exhibit a characteristic longitudinal elasticity coefficient, indicated by a double-chained line, having a glass-transition temperature $T_3$.

Note, by suitably varying compositions of the shape memory resin and/or by selecting a suitable one from among various types of shape memory resin, it is possible to obtain the respective shape memory resins, with the glass-transition temperatures $T_1$, $T_2$ and $T_3$.

Figure 4:
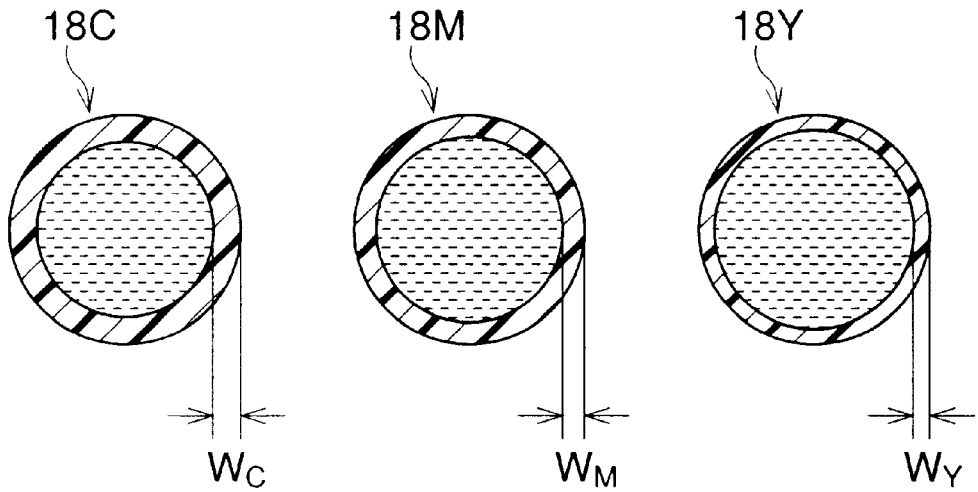
FIG. 4 is a schematic cross-sectional view showing different shell wall thicknesses of the respective cyan, magenta and yellow microcapsules.

As shown in FIG. 4, the microcapsule walls of the cyan microcapsules 18C, magenta microcapsules 18M, and yellow microcapsules 18Y have differing thicknesses $W_C$, $W_M$ and $W_Y$, respectively. Namely, the thickness $W_C$ of cyan microcapsules 18C is larger than the thickness $W_M$ of magenta microcapsules 18M, and the thickness $W_M$ of magenta microcapsules 18M is larger than the thickness $W_Y$ of yellow microcapsules 18Y.

Also, the wall thickness $W_C$ of the cyan microcapsules 18C is selected such that each cyan microcapsule 18C is compacted and broken under a breaking pressure that lies between a critical breaking pressure $P_3$ and an upper limit pressure $P_{UL}$ (FIG. 3), when each cyan microcapsule 18C is heated to a temperature between the glass-transition temperatures $T_1$ and $T_2$; the wall thickness $W_M$ of the magenta microcapsules 18M is selected such that each magenta microcapsule 18M is compacted and broken under a breaking pressure that lies between a critical breaking pressure $P_2$ and the critical breaking pressure $P_3$ (FIG. 3), when each magenta microcapsule 18M is heated to a temperature between the glass-transition temperatures $T_2$ and $T_3$; and the wall thickness $W_Y$ of the yellow microcapsules 18Y is selected such that each yellow microcapsule 18Y is compacted and broken under a breaking pressure that lies between a critical breaking pressure $P_1$ and the critical breaking pressure $P_2$ (FIG. 3), when each yellow microcapsule 1BY is heated to a temperature between the glass-transition temperature $T_3$ and an upper limit temperature $T_{UL}$.

Note, the upper limit pressure $P_{UL}$ and the upper limit temperature $T_{UL}$ are suitably set in view of the characteristics of the used shape memory resins.

As is apparent from the foregoing, by suitably selecting a heating temperature and a breaking pressure, which should be exerted on the image-forming sheet 10, it is possible to selectively squash and break the cyan, magenta and yellow microcapsules 18C, 18M and 18Y.

Figure 5:
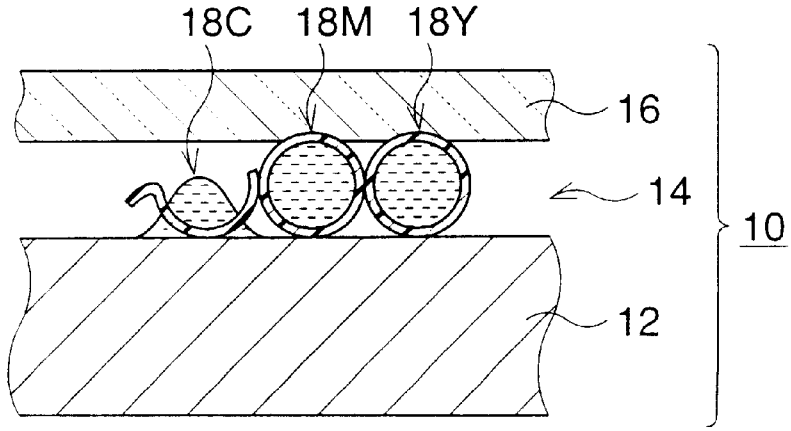
FIG. 5 is a schematic conceptual cross-sectional view similar to FIG. 1, showing only a selective breakage of a cyan microcapsule in the layer of microcapsules.

For example, if the selected heating temperature and breaking pressure fall within a hatched cyan-developing area C (FIG. 3), defined by a temperature ranging between the glass-transition temperatures $T_1$ and $T_2$ and by a pressure ranging between the critical breaking pressure $P_3$ and the upper limit pressure $P_{UL}$, only the cyan microcapsules 18C are squashed and broken, as representatively shown in FIG. 5. Also, if the selected heating temperature and breaking pressure fall within a hatched magenta-developing area M, defined by a temperature ranging between the glass-transition temperatures $T_2$ and $T_3$ and by a pressure ranging between the critical breaking pressures $P_2$ and $P_3$, only the magenta microcapsules 18M are squashed and broken. Further, if the selected heating temperature and breaking pressure fall within a hatched yellow-developing area Y, defined by a temperature ranging between the glass-transition temperature $T_3$ and the upper limit temperature $T_{UL}$ and by a pressure ranging between the critical breaking pressures $P_1$ and $P_2$, only the yellow microcapsules 18Y are squashed and broken.

Accordingly, if the selection of a heating temperature and a breaking pressure, which should be exerted on the image-forming sheet 10, are suitably controlled in accordance with a series of digital color image-pixel signals: digital cyan image-pixel signals, digital magenta image-pixel signals and digital yellow image-pixel signals, it is possible to form a color image on the image-forming sheet 10 on the basis of the digital color image-pixel signals.

Figure 6:
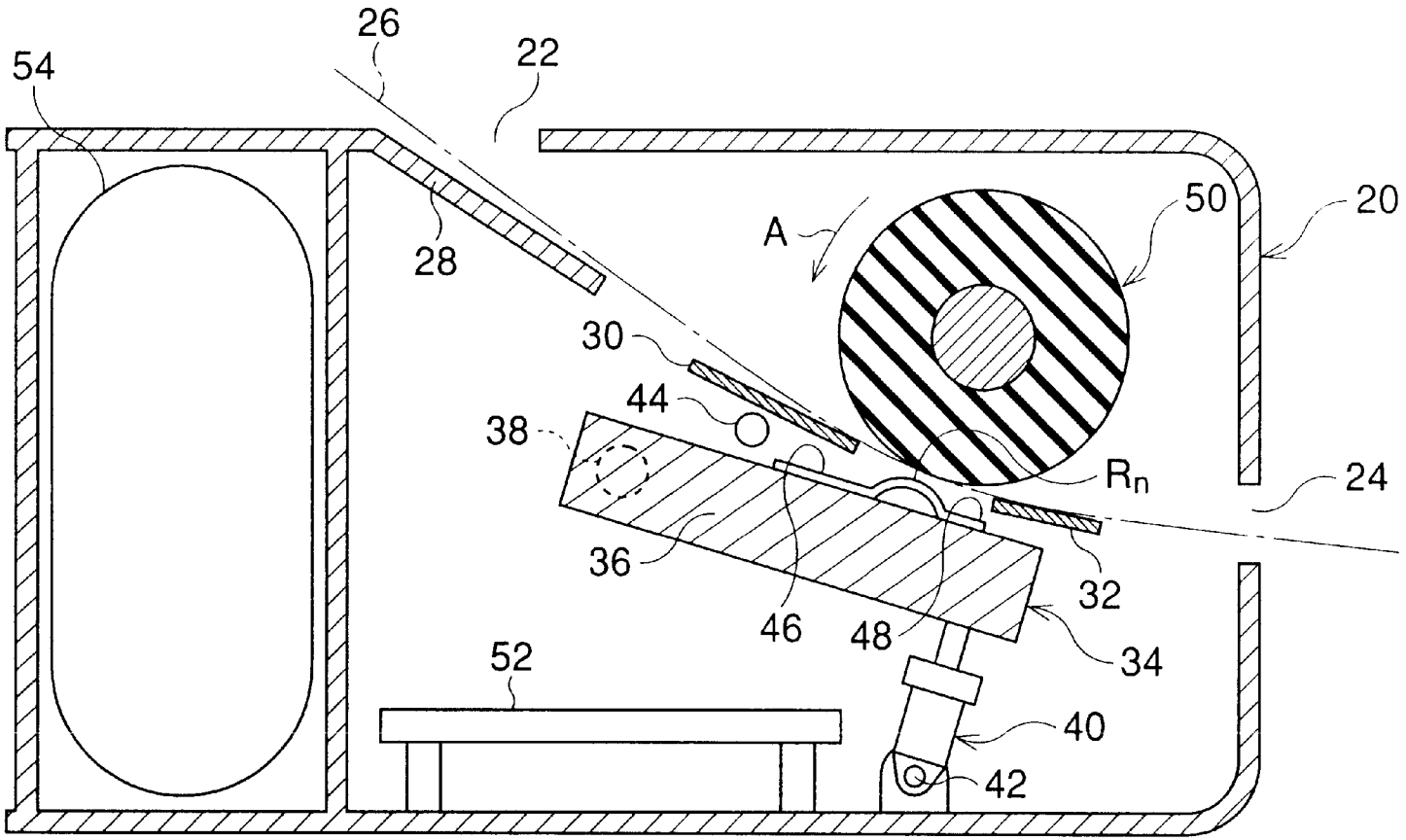
FIG. 6 is a schematic cross-sectional view of a first embodiment of an image-forming apparatus, according to the present invention, for forming a color image on the image-forming substrate shown in FIG. 1.

FIG. 6 schematically shows an embodiment of an image-forming apparatus, used in the image-forming system according to the present invention, which is constituted as a line color printer so as to form a color image on the image-forming sheet 10.

The color printer comprises a rectangular parallelopiped housing 20 having an entrance opening 22 and an exit opening 24 formed in a top wall and a side wall of the housing 20, respectively. The image-forming sheet 10 is introduced into the housing 20 through the entrance opening 22, and is then discharged from the exit opening 24 after the formation of a color image on the image-forming sheet 10.

In FIG. 6, a path 26 for movement of the image-forming sheet 10 is indicated by a chained line. This path 26 is defined by a first guide plate 28, a second guide plate 30 and a third guide plate 32, which are provided in the housing 20, suitably spaced apart from each other.

The color printer is provided with a movable thermal head assembly 34 disposed below the path 26 and the movable thermal head assembly 34 is rotatable between two rotational positions.

In particular, the movable thermal head assembly 34 comprises an elongated rectangular base plate member 36 formed of, for example, a suitable ceramic material, and the base plate member 36 has a pair of stub shafts 38 protruding from the lateral side faces of the base plate member 36. The stub shafts 38 are aligned with each other on an axis of rotation that extends along one of the longitudinal side faces of the base plate member 36, and are rotatably supported by two suitable bearings (not shown ) securely attached to a structural frame (not shown) of the printer.

As shown in FIG. 6, the base plate member 36 is provided with a solenoid actuator 40, a cylinder portion of which is pivoted at a location indicated by reference 42 in FIG. 6, and a plunger of the solenoid actuator 40 suitably contacts the base plate member 36 near the other longitudinal side that opposes the stub shafts 38. A stopper shaft 44 is provided just below the guide plate 30 and above an upper surface of the base plate member 36.

With this arrangement, the base plate member 36, and therefore the movable thermal head assembly 34, are rotatable between a first position as shown in FIG. 6, and a second position at which the base plate member 34 abuts the stopper shaft 44. Namely, when the solenoid actuator 40 is electrically deenergized, the thermal head assembly 34 is kept at the first position, but when the solenoid actuator 40 is electrically energized, the thermal head assembly 34 rotates from the first position to the second position.

Figure 7:
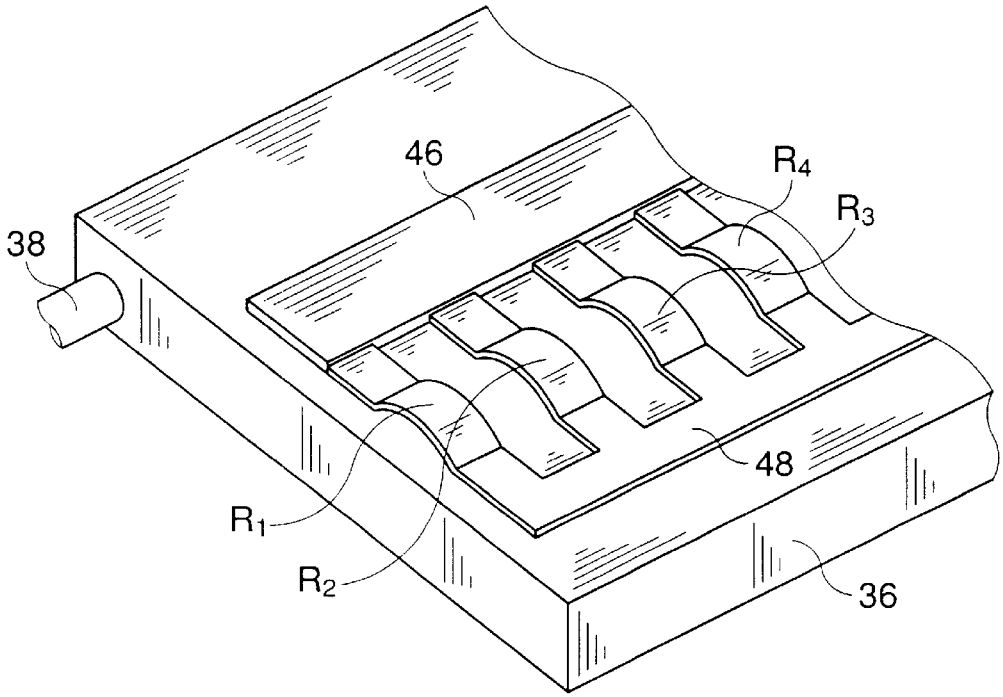
FIG. 7 is a partial perspective view showing a thermal head assembly incorporated in the image-forming apparatus shown in FIG. 6.

As shown in FIG. 7, the movable thermal head assembly 34 also comprises an array of n electric resistance elements $R_n$ provided and aligned on the upper surface of the base plate member 36, with four of the electric resistance elements $R_n$ being indicated by references $R_1$, $R_2$, $R_3$ and $R_4$ in FIG. 7. According to the present invention, each of the electric resistance elements $R_n$ is formed as an arcuate bimetal element that serves as a pressure/temperature application element, as stated in detail hereinafter.

The electric resistance elements or arcuate bimetal elements $R_n$ are connected to an integrated driver circuit pattern 46, formed on the upper surface of the base plate member 36, and are also connected to a grounded common terminal pattern 48, also formed on the upper surface of the base plate member 36. Note, the patterns 46 and 48 may be obtained by using photolithography.

The color printer is also provided with a roller platen 50, which may be formed of a suitable hard rubber material, and is positioned such that a portion of the peripheral surface of the roller platen 50 is exposed at a space between the guide plates 30 and 32 to the array of arcuate bimetal elements $R_n$. Namely, when the movable thermal head assembly 34 is rotated from the first position to the second position, the array of bimetal elements $R_n$ is pressed against the roller platen 50 at a predetermined pressure.

Note, in FIG. 6, for the convenience of illustration, although the movable thermal head assembly 34 and the roller platen 50 are shown with there being a relatively-wide gap between the array of bimetal elements $R_n$ and the roller platen 50 when the thermal head assembly 34 is at the first position, in reality, the movable thermal head assembly 34 is positioned in the vicinity of the roller platen 50 as if the array of bimetal elements $R_n$ is in substantial contact with the roller platen 50. Namely, a rotational stroke of the thermal head assembly 34 between the first position and the second position is very small.

During a printing operation of the printer, the roller platen 50 is intermittently rotated in a direction indicated by an arrow A (FIG. 6), so that the image-forming sheet 10 is intermittently moved between the roller platen 50 and the array of bimetal elements $R_n$, due to the image-forming sheet 10 being subjected to a traction force from the roller platen 50 during the intermittent rotation. During the intermittent movement of the image-forming sheet 10, a color image is formed and printed line by line on the image-forming sheet 10, and the printing of the color image line by line is performed by rotationally driving the thermal head assembly 34 from the first position to the second position. Note, the image-forming sheet 10 to be printed is introduced into the entrance opening 22 such that the protective transparent film 16 of the image-forming sheet 10 comes into contact with the array of bimetal elements $R_n$.

When each of the bimetal elements $R_n$ is not electrically energized, i.e. when each of the bimetal elements $R_n$ is not electrically heated, a degree of protrusion of each bimetal element ($R_n$) is a maximum. When each bimetal element ($R_n$) is heated by the electrical energization thereof, the degree of protrusion of each bimetal element ($R_n$) is reduced. Therefore, when the movable thermal head assembly 34 is rotated from the first position or non-printing position to the second position or printing position after one of the bimetal elements $R_n$ is electrically heated during a given period of time, a pressure, exerted on the roller platen 50 by the electrically-heated bimetal element concerned, is smaller than a pressure exerted on the roller platen 50 by one of the bimetal elements $R_n$ that is not electrically-heated.

In this embodiment, when the movable thermal head assembly 34 is at the printing position, the maximum degree of protrusion of each bimetal element ($R_n$), not electrically-heated, is set such that a pressure, exerted on the roller platen 50 by the bimetal element concerned, is substantially equal to the upper limit pressure $P_{UL}$ (FIG. 3).

Figure 8:
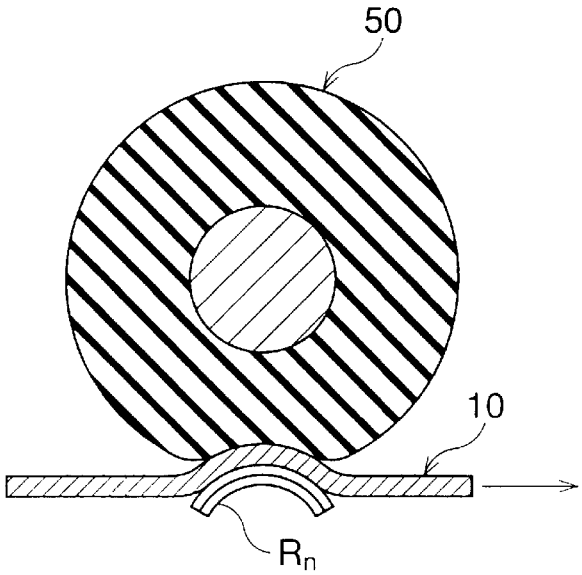
FIG. 8 is a cross-sectional view of a roller platen and an arcuate bimetal element pressed thereagainst for explaining a pressure/temperature application characteristic of the arcuate bimetal element.

When the movable thermal head assembly 34 is rotated from the non-printing position to the printing position after one of the bimetal elements $R_n$ is electrically heated to a temperature ranging between the glass-transition temperatures $T_1$ and $T_2$, the degree of protrusion of the heated bimetal element ($R_n$) concerned is reduced so that the pressure, exerted on the roller platen 50 thereby, is lowered to a pressure ranging between the upper limit pressure $P_{UL}$ and the critical-breaking pressure $P_3$ (FIG. 3). Accordingly, if the image-forming sheet 10 is interposed between the roller platen 50 and the array of bimetal elements $R_n$, as shown in FIG. 8, a local area of the microcapsule layer 14, against which the arcuate bimetal element ($R_n$) concerned is pressed, is subjected to the temperature ranging between the glass-transition temperatures $T_1$ and $T_2$ and the pressure ranging between the upper limit pressure $P_{UL}$ and the critical-breaking pressure $P_3$ (FIG. 3). Thus, only the cyan microcapsules 18C, included in the local area of the microcapsule layer 14, are compacted and broken, resulting in a seepage of the cyan dye therefrom, whereby the local area concerned is developed as a cyan dot on the microcapsule layer 14 of the image-forming sheet 10.

Figure 9:
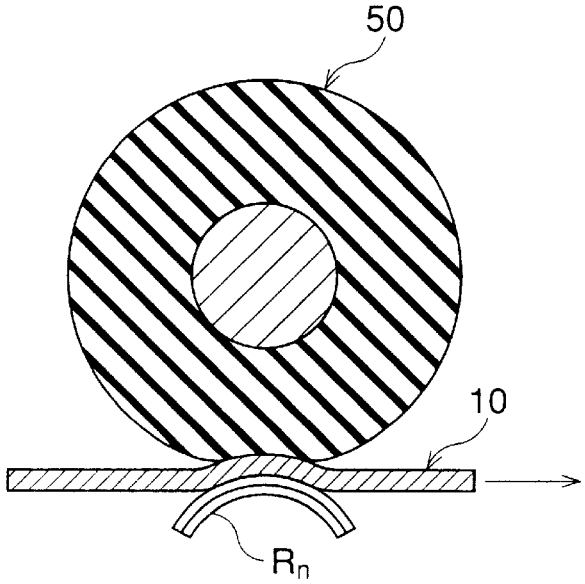
FIG. 9 is a partial cross-sectional view, similar to FIG. 8, for explaining the pressure/temperature application characteristic of the arcuate bimetal element.

Also, when the movable thermal head assembly 34 is rotated from the non-printing position to the printing position after one of the bimetal elements $R_n$ is electrically heated to a temperature ranging between the glass-transition temperatures $T_2$ and $T_3$, the degree of protrusion of the heated bimetal element ($R_n$) concerned is reduced so that the pressure, exerted on the roller platen 50 thereby, is lowered to a pressure ranging between the critical-breaking pressures $P_2$ and $P_3$ (FIG. 3). Accordingly, if the image-forming sheet 10 is interposed between the roller platen 50 and the array of bimetal elements $R_n$, as shown in FIG. 9, a local area of the microcapsule layer 14, against which the arcuate bimetal element ($R_n$) concerned is pressed, is subjected to the temperature ranging between the glass-transition temperatures $T_2$ and $T_3$ and the pressure ranging between the critical-breaking pressures $P_2$ and $P_3$ (FIG. 3). Thus, only the magenta microcapsules 18M, included in the local area of the microcapsule layer 14, are compacted and broken, resulting in a seepage of the magenta dye therefrom, whereby the local area concerned is developed as a magenta dot on the microcapsule layer 14 of the image-forming sheet 10.

Figure 10:
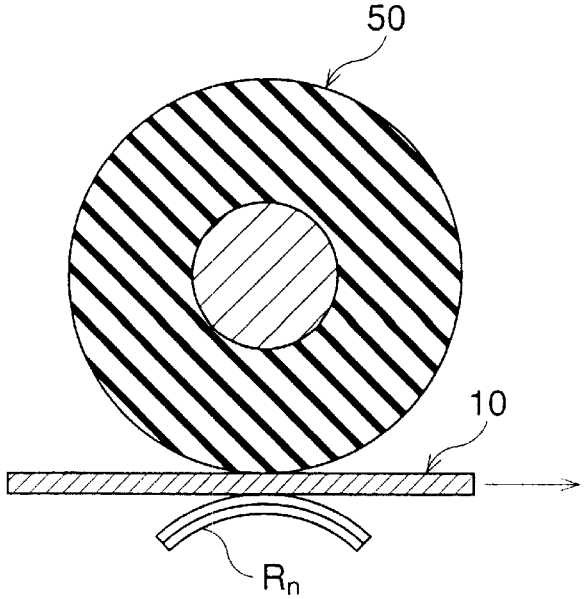
FIG. 10 is a partial cross-sectional view, similar to FIG. 8, for explaining the pressure/temperature application characteristic of the arcuate bimetal element.

Similarly, when the movable thermal head assembly 34 is rotated from the non-printing position to the printing position after one of the bimetal elements $R_n$ is electrically heated to a temperature ranging between the glass-transition temperatures $T_3$ and $T_4$, the degree of protrusion of the heated bimetal element ($R_n$) concerned is reduced so that the pressure, exerted on the roller platen 50 thereby, is lowered to a pressure ranging between the critical-breaking pressures $P_1$ and $P_2$ (FIG. 3). Accordingly, if the image-forming sheet 10 is interposed between the roller platen 50 and the array of bimetal elements $R_n$, as shown in FIG. 10, a local area of the microcapsule layer 14, against which the arcuate bimetal element ($R_n$) concerned is pressed, is subjected to the temperature ranging between the glass-transition temperatures $T_3$ and $T_{UL}$ and the pressure ranging between the critical-breaking pressures $P_1$ and $P_2$ (FIG. 3). Thus, only the yellow microcapsules 18Y, included in the local area of the microcapsule layer 14, are compacted and broken, resulting in a seepage of the yellow dye therefrom, whereby the local area concerned is developed as a yellow dot on the microcapsule layer 14 of the image-forming sheet 10.

Referring again to FIG. 6, reference 52 indicates a control circuit board for controlling a printing operation of the color printer, and reference 54 indicates an electrical main power source for electrically energizing the control circuit board 52, the solenoid actuator 40, the array of bimetal elements $R_n$ and so on.

Figure 11:
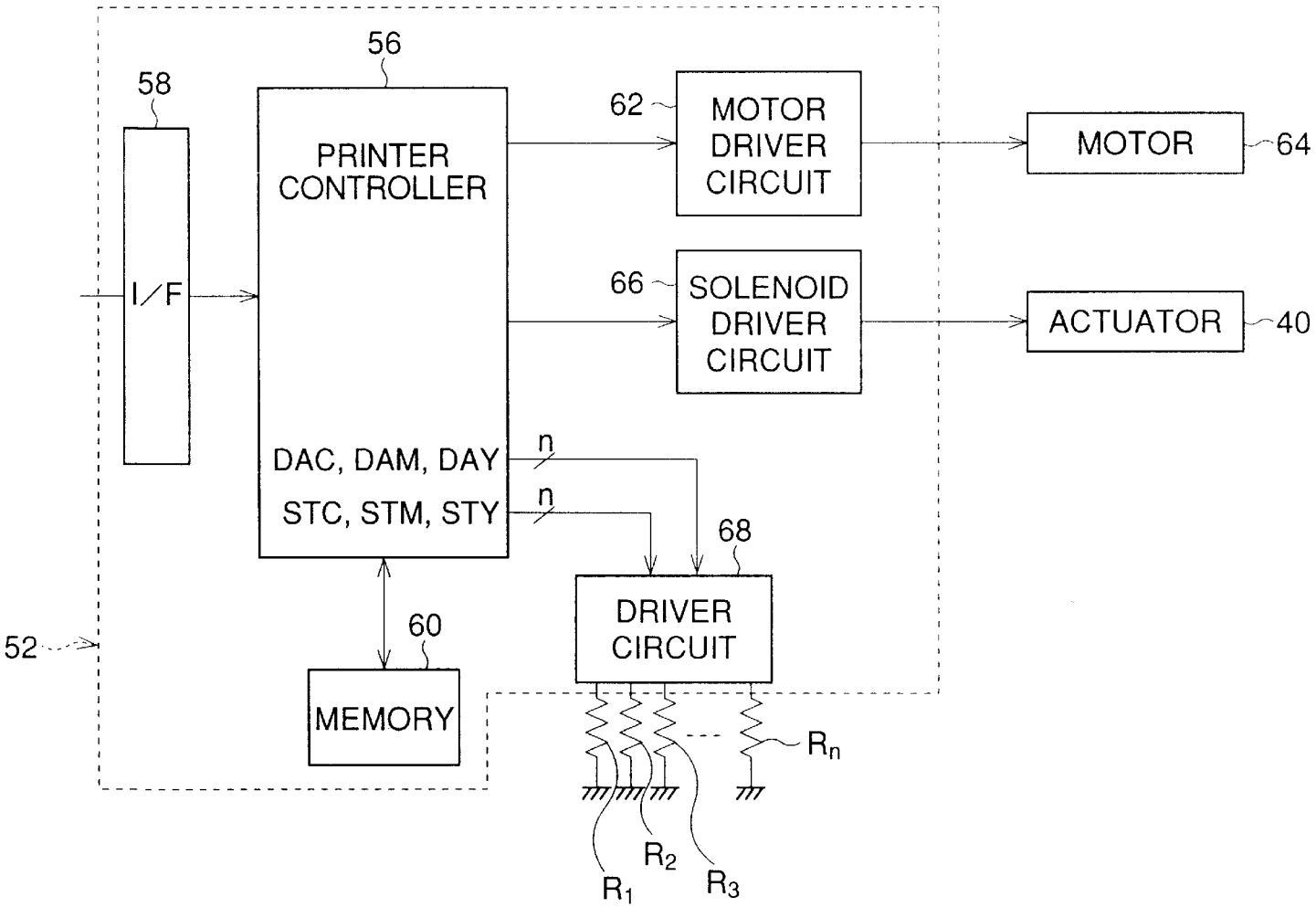
FIG. 11 is a schematic block diagram of a control circuit board of the image-forming apparatus shown in FIG. 6.

FIG. 11 shows a schematic block diagram of the control circuit board 52. As shown in this drawing, the control circuit board 52 comprises a printer controller 56 that includes a microcomputer. The printer controller 56 receives a series of digital color image-pixel signals from a personal computer or a word processor (not shown) through an interface circuit (I/F) 58. The received digital color image-pixel signals are then once stored in a memory 60.

Also, the control circuit board 52 is provided with a motor driver circuit 62 for driving an electric motor 64, such as a stepping motor, a servo motor, or the like, which is used to rotationally drive the roller platen 50 in accordance with a series of drive pulses outputted from the motor driver circuit 62. The outputting of drive pulses from the motor driver circuit 62 to the electric motor 64 is controlled by the printer controller 56.

Further, the control circuit board 52 is provided with a solenoid driver circuit 66 for electrically energizing the solenoid actuator 40 (FIG. 6). The electrical energization of the solenoid actuator 40 by the solenoid driver circuit 66 is performed under control of the printer controller 56. As stated above, the solenoid actuator 40 is usually deenergized, so that the movable thermal head assembly 34 is kept at the first position or non-printing position. When the solenoid actuator 40 is electrically energized by the solenoid driver circuit 66, the thermal head assembly 34 is rotationally driven from the first position or non-printing position to the second position or printing position.

As shown in FIG. 11, the control circuit board 52 is further provided with a driver circuit 68, which is controlled by the printer controller 56 to selectively and electrically energize the n arcuate bimetal elements $R_1$ to $R_n$. Namely, the selective and electric energizations of the n arcuate bimetal elements $R_1$ to $R_n$ are controlled by n sets of strobe signals "STC" and control signals "DAC", n sets of strobe signals "STM" and control signals "DAM", and n sets of strobe signals "STY" and control signals "DAY", respectively, which are outputted from the printer controller 56 to the driver circuit 68 in accordance with a single-line of digital color image-pixel signals: a single-line of digital cyan image-pixel signals, a single-line of digital magenta image-pixel signals and a single-line of digital yellow image-pixel signals.

Figure 12:
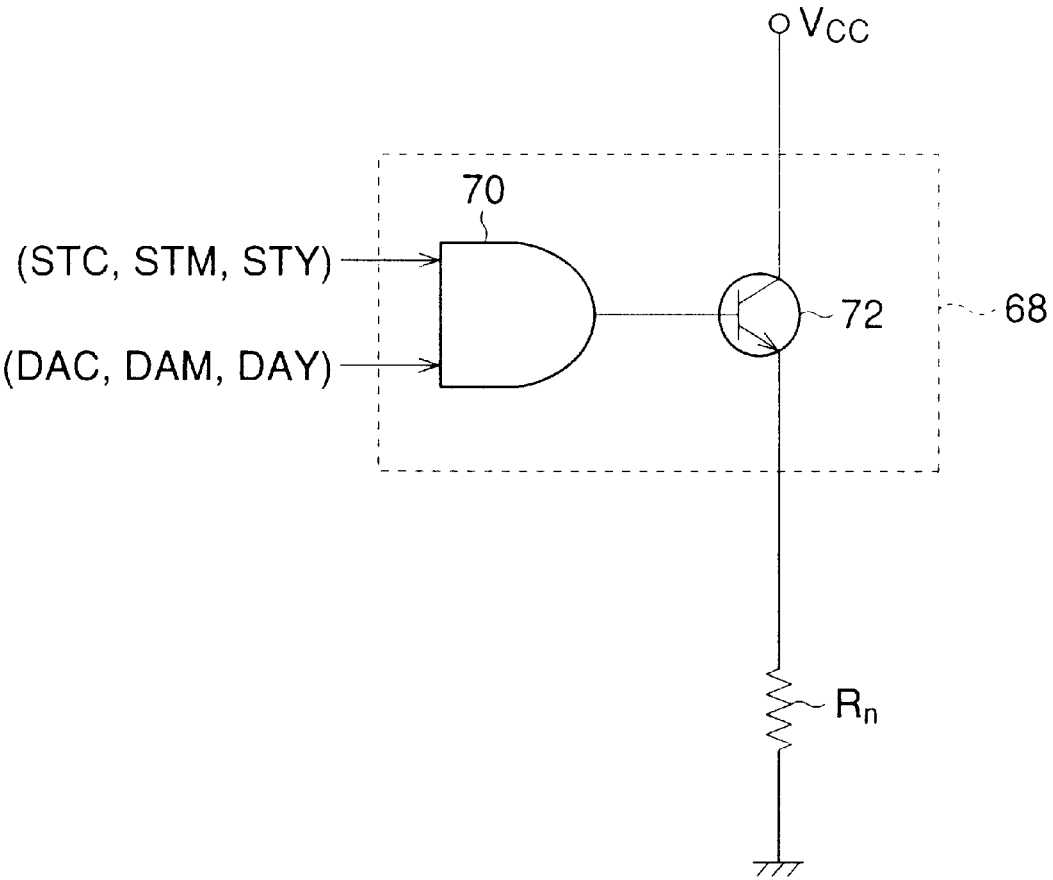
FIG. 12 is a partial block diagram representatively showing a set of an AND-gate circuit and a transistor included in a thermal head driver circuit of FIG. 11.

The driver circuit 68 includes n sets of AND-gate circuits and transistors respectively provided for the arcuate bimetal elements $R_1$ to $R_n$. With reference to FIG. 12, an AND-gate circuit and a transistor in one set are representatively shown and indicated by references 70 and 72, respectively. A set of a strobe signal (STC, STM or STY) and a control signal (DAC, DAM or DAY) is inputted from the printer controller 56 to two input terminals of the AND-gate circuit 70. A base of the transistor 72 is connected to an output terminal of the AND-gate circuit 70; a collector of the transistor 72 is connected to an electric power source ($V_{cc}$); and an emitter of the transistor 72 is connected to a corresponding arcuate bimetal element ($R_n$).

Figure 13:
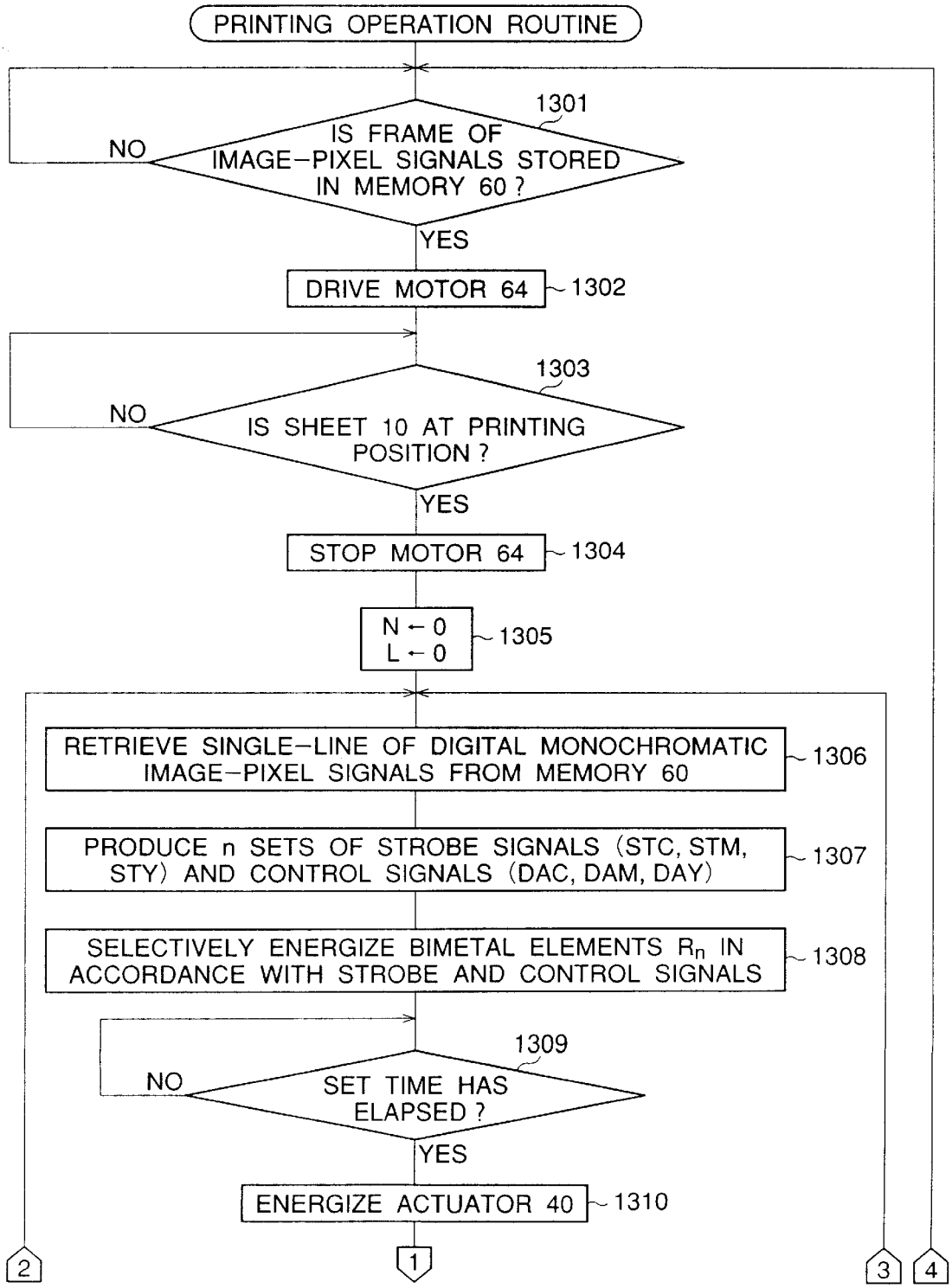
FIG. 13 shows a part of a flowchart of a printing operation routine executed in a printer controller in accordance with the first embodiment of the image-forming system of the present invention.
Figure 14:
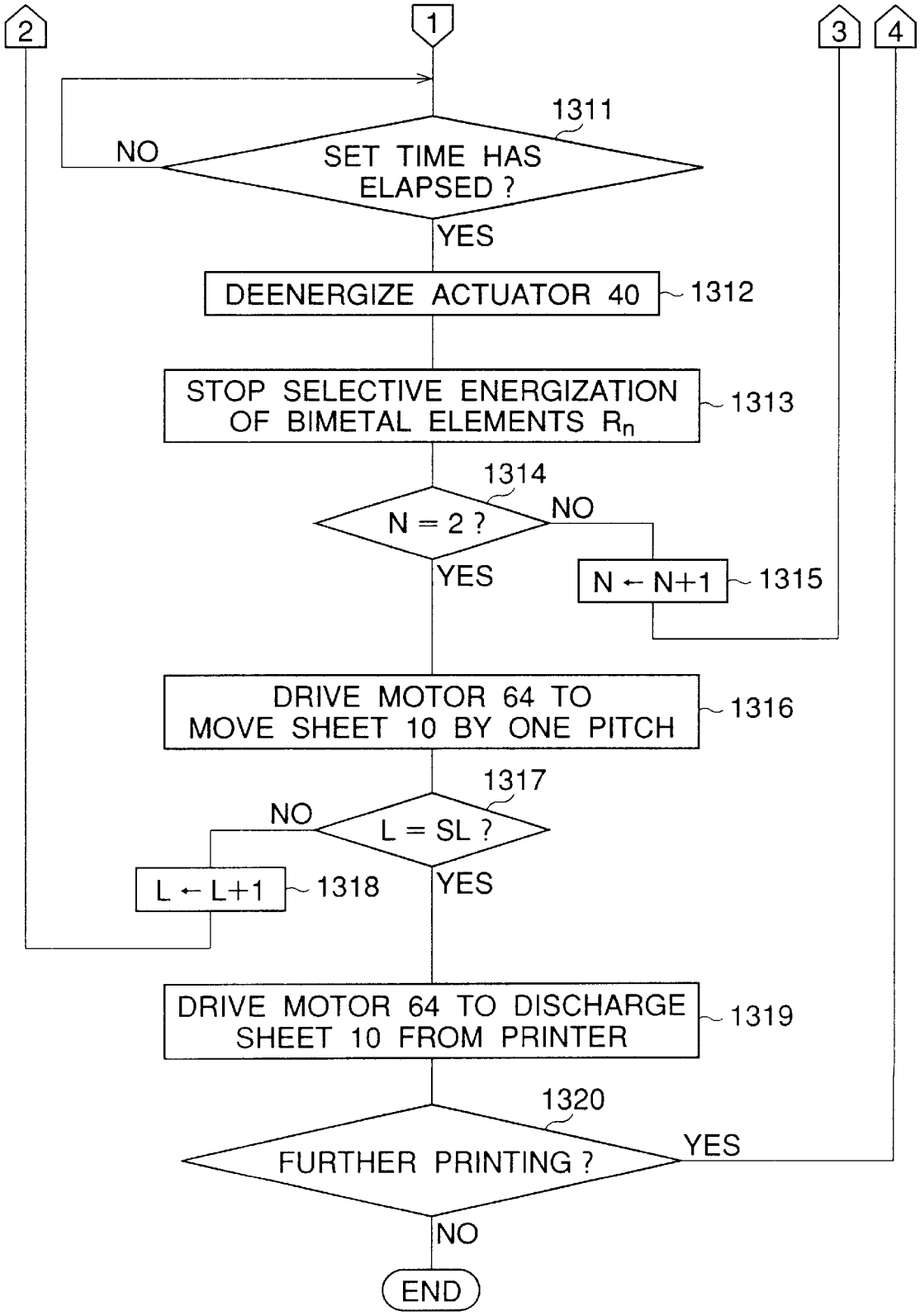
FIG. 14 shows the remaining part of the flowchart of the printing operation routine executed in the printer controller in accordance with the first embodiment of the image-forming system of the present invention.

With reference to FIGS. 13 and 14, showing a flowchart of a printing operation routine executed in the printer controller 52 in accordance with the first embodiment of the present invention, a printing operation will now be explained below.

At step 1301, it is determined whether a single-frame of color (cyan, magenta, yellow) image-pixel signals is stored in the memory 60. As mentioned above, the single-frame of color image-pixels signals can be obtained from a personal computer or a word processor (not shown) through the interface circuit (I/F) 58. When the storage of the single-frame of color image-pixel signals in the memory 60 is confirmed, the control proceeds to step 1302, in which the electric motor 64 is driven so that an image-forming sheet 10 to be printed is moved toward an initial printing position.

At step 1303, it is determined whether the image-forming sheet 10 has reached the initial printing position, i.e. the image-forming sheet 10 is positioned at the printing position. When the positioning of the image-forming sheet 10 is confirmed, the control proceeds to step 1304, and the driving of the electric motor 64 is stopped. Then, at step 1305, the counters N and L are reset.

Figure 15:
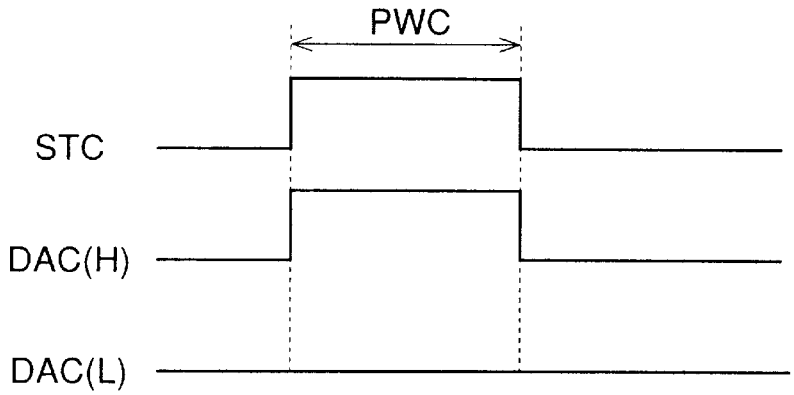
FIG. 15 is a timing chart showing a strobe signal and a control signal for electronically actuating the thermal-head driver circuit for producing a cyan dot on the image-forming substrate of FIG. 1.

At step 1306, a single-line of digital monochromatic image-pixel signals included in a first single-line of digital color image-pixel signals is retrieved from the memory 60 by the printer controller 56. Note, at the present stage, since N=0, the retrieved digital monochromatic image-pixel signals are cyan image-pixel signals. Then, at step 1307, n sets of strobe signals "STC" and control signals "DAC" are produced in accordance with the single-line of digital cyan image-pixel signals. In particular, when a set of a strobe signal "STC" and a control signal "DAC" is produced in accordance with a corresponding digital cyan image-pixel signal, the control signal "DAC" varies in accordance with binary values of the corresponding digital cyan image-pixel signal. Namely, as shown in a timing chart of FIG. 15, when the digital cyan image-pixel signal has a value "1", the control signal "DAC" is outputted as a high-level pulse having a same pulse width "PWC" as that of the strobe signal "STC", whereas, when the digital cyan image-pixel signal has a value "0", the control signal "DAC" is maintained at a low-level.

At step 1308, the n bimetal elements $R_n$ are selectively and electrically energized in accordance with the n sets of strobe signals "STC" and control signals "DAC". Namely, only when a digital cyan image-pixel signal has the value "1", is a corresponding transistor (72) switched ON during a period corresponding to the pulse width "PWC" of the strobe signal "STC", so that a corresponding bimetal element ($R_n$) is electrically energized.

At step 1309, it is determined whether a predetermined very short time has elapsed such that the electrically-energized bimetal element ($R_n$) is heated to the temperature ranging between the glass-transition temperatures $T_1$ and $T_2$. After the predetermined set time has elapsed, the control proceeds to step 1310, in which the solenoid actuator 40 is electrically energized by the solenoid driver circuit 66 so that the thermal head assembly 34 is rotated from the first position or non-printing position (FIG. 3) to the second position or printing position, whereby the heated bimetal elements ($R_n$) develop cyan dots along a first single-line on the microcapsule layer 14 of the image-forming sheet 10.

At step 1311, it is determined whether a predetermined very short time has elapsed, such that the development of the cyan dots can be surely carried out. After the predetermined set time has elapsed, the control proceeds to step 1312, in which the solenoid actuator 40 is deenergized by the solenoid driver circuit 66 so that the thermal head assembly 34 is rotated from the printing position to the non-printing position (FIG. 3). Then, at step 1313, the selective energization of the bimetal elements ($R_n$) is stopped.

At step 1314, it is determined whether the count number of the counter N is equal to "2". When the count number of the counter N has not reached "2", the control proceeds to step 1315, in which the count number N is incremented by "1". Then, the control returns to step 1306.

Figure 16:
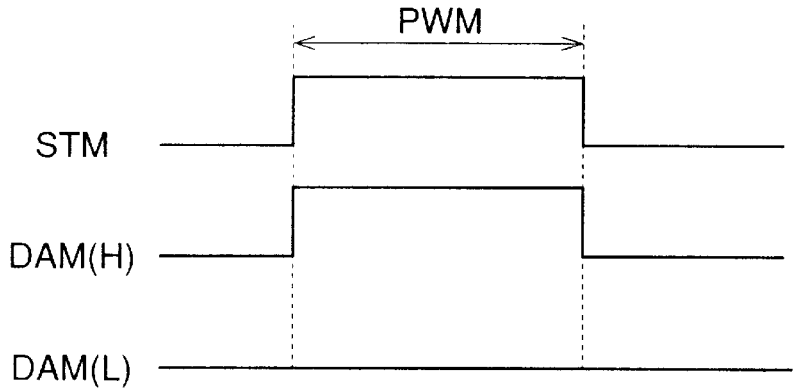
FIG. 16 is a timing chart showing a strobe signal and a control signal for electronically actuating the thermal-head driver circuit for producing a magenta dot on the image-forming substrate of FIG. 1.

At step 1306, when the count number N is equal to "1", another single-line of digital monochromatic image-pixel signals included in the first single-line of color image-pixel image-pixel signals is retrieved from the memory 60 by the printer controller 56. Note, at the present stage, since N=1, the retrieved digital monochromatic image-pixel signals are magenta image-pixel signals. Then, at step 1307, n sets of strobe signals "STM" and control signals "DAM" are produced in accordance with the single-line of digital magenta image-pixel signals. In particular, when a set of a strobe signal "STM" and a control signal "DAM" is produced in accordance with a corresponding digital magenta image-pixel signal, the control signal "DAM" varies in accordance with binary values of the corresponding digital magenta image-pixel signal. Namely, as shown in a timing chart of FIG. 16, when the digital magenta image-pixel signal has a value "1", the control signal "DAM" is outputted as a high-level pulse having a same pulse width "PWM" as that of the strobe signal "STM", which is longer than the pulse width "PWC" of the strobe signal "STC". However, when the digital magenta image-pixel signal has a value "0", the control signal "DAM" is maintained at a low-level.

At step 1308, the n bimetal elements $R_n$ are selectively and electrically energized in accordance with the n sets of strobe signals "STM" and control signals "DAM". Namely, only when a digital magenta image-pixel signal has the value "1", is a corresponding transistor (72) switched ON during a period corresponding to the pulse width "PWM" of the strobe signal "STM", so that a corresponding bimetal element ($R_n$) is electrically energized.

At step 1309, it is determined whether a predetermined very short time has elapsed such that the electrically-energized bimetal element ($R_n$) is heated to the temperature ranging between the glass-transition temperatures $T_2$ and $T_3$. After the predetermined set time has elapsed, the control proceeds to step 1310, in which the solenoid actuator 40 is electrically energized by the solenoid driver circuit 66 so that the thermal head assembly 34 is rotated from the nonprinting position (FIG. 3) to the printing position, whereby the heated bimetal elements ($R_n$) develop magenta dots long the first single-line on the microcapsule layer 14 of the image-forming sheet 10.

At step 1311, it is determined whether a predetermined very short time has elapsed, such that the development of the magenta dots can be surely carried out. After the predetermined set time has elapsed, the control proceeds to step 1312, in which the solenoid actuator 40 is deenergized by the solenoid driver circuit 66 so that the thermal head assembly 34 is rotated from the printing position to the non-printing position (FIG. 3). Then, at step 1313, the selective energization of the bimetal elements ($R_n$) is stopped.

At step 1314, it is determined whether the count number of the counter N is equal to "2". When the count number of the counter N has not reached "2", the control proceeds to step 1315, in which the count number N is incremented by "1". Then, the control further returns to step 1306.

Figure 17:
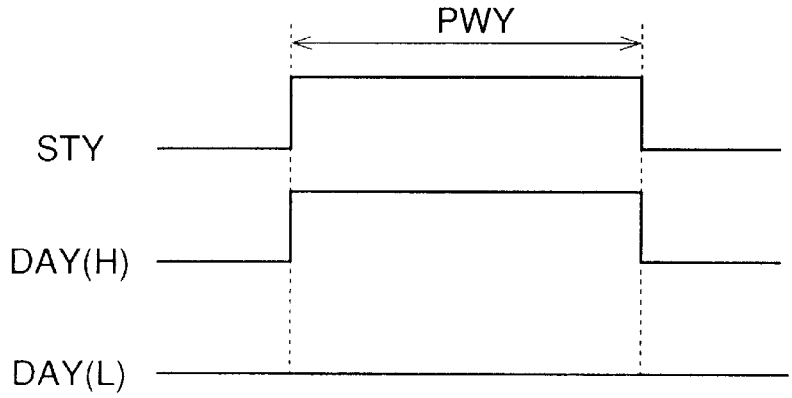
FIG. 17 is a timing chart showing a strobe signal and a control signal for electronically actuating the thermal-head driver circuit for producing a yellow dot on the image-forming substrate of FIG. 1.

At step 1306, when the count number N is equal to "2", the remaining single-line of digital monochromatic image-pixel signals included in the first single-line of color image-pixel image-pixel signals is retrieved from the memory 60 by the printer controller 56. Note, at the present stage, since N=2, the retrieved digital monochromatic image-pixel signals are yellow image-pixel signals. Then, at step 1307, n sets of strobe signals "STY" and control signals "DAY" are produced in accordance with the single-line of digital yellow image-pixel signals. In particular, when a set of a strobe signal "STY" and a control signal "DAY" is produced in accordance with a corresponding digital yellow image-pixel signal, the control signal "DAY" varies in accordance with binary values of the corresponding digital yellow image-pixel signal. Namely, as shown in a timing chart of FIG. 17, when the digital yellow image-pixel signal has a value "1", the control signal "DAY" is outputted as a high-level pulse having a same pulse width "PWY" as that of the strobe signal "STY", which is longer than the pulse width "PWM" of the strobe signal "STM". However, when the digital yellow image-pixel signal has a value "0", the control signal "DAY" is maintained at a low-level.

At step 1308, the n bimetal elements $R_n$ are selectively and electrically energized in accordance with the n sets of strobe signals "STY" and control signals "DAY". Namely, only when a digital yellow image-pixel signal has the value "1", is a corresponding transistor (72) switched ON during a period corresponding to the pulse width "PWY" of the strobe signal "STY", so that a corresponding bimetal element ($R_n$) is electrically energized.

At step 1309, it is determined whether a predetermined very short time has elapsed such that the electrically-energized bimetal element ($R_n$) is heated to the temperature ranging between the glass-transition temperature $T_3$ and the upper limit temperature $T_{UL}$. After the predetermined set time has elapsed, the control proceeds to step 1310, in which the solenoid actuator 40 is electrically energized by the solenoid driver circuit 66 so that the thermal head assembly 34 is rotated from the non-printing position (FIG. 3) to the printing position, whereby the heated bimetal elements ($R_n$) develop yellow dots long the first single-line on the microcapsule layer 14 of the image-forming sheet 10.

At step 1311, it is determined whether a predetermined very short time has elapsed, such that the development of the yellow dots can be surely carried out. After the predetermined set time has elapsed, the control proceeds to step 1312, in which the solenoid actuator 40 is deenergized by the solenoid driver circuit 66 so that the thermal head assembly 34 is rotated from the printing position to the non-printing position (FIG. 3). Then, at step 1313, the selective energization of the bimetal elements ($R_n$) is stopped.

At step 1314, it is determined whether the count number of the counter N is equal to "2". At this stage, since N=2, the control proceeds to step 1316, in which the electric motor 64 is driven such that the image-forming sheet 10 is moved by one pitch, being one line. Then, at step 1314, it is determined whether a count number of the counter L is equal to "SL", which represents a sum of single-lines of color image-pixel signals corresponding to a frame of digital color image-pixels. When L<SL, the control proceeds to step 1318, in which the count number of the counter L is incremented by "1", and then the control returns to step 1306. Namely, a line-by-line color printing, as mentioned above, is repeated in accordance with the consecutive single-lines of digital color image-pixel signals until the count number of the counter L reaches "SL".

At step 1317, when the count number L has reached "SL", i.e. when all of the line-by-line color printings are completed, the control proceeds to step 1319, in which the electric motor 64 is driven so that the image-forming sheet 10 carrying the printed color image is discharged from the printer. Then, it is determined whether a further printing operation should be performed. If a further printing operation is to be performed, the control returns to step 1301. If a further printing operation is not to be performed, this routine ends.

Figure 18:
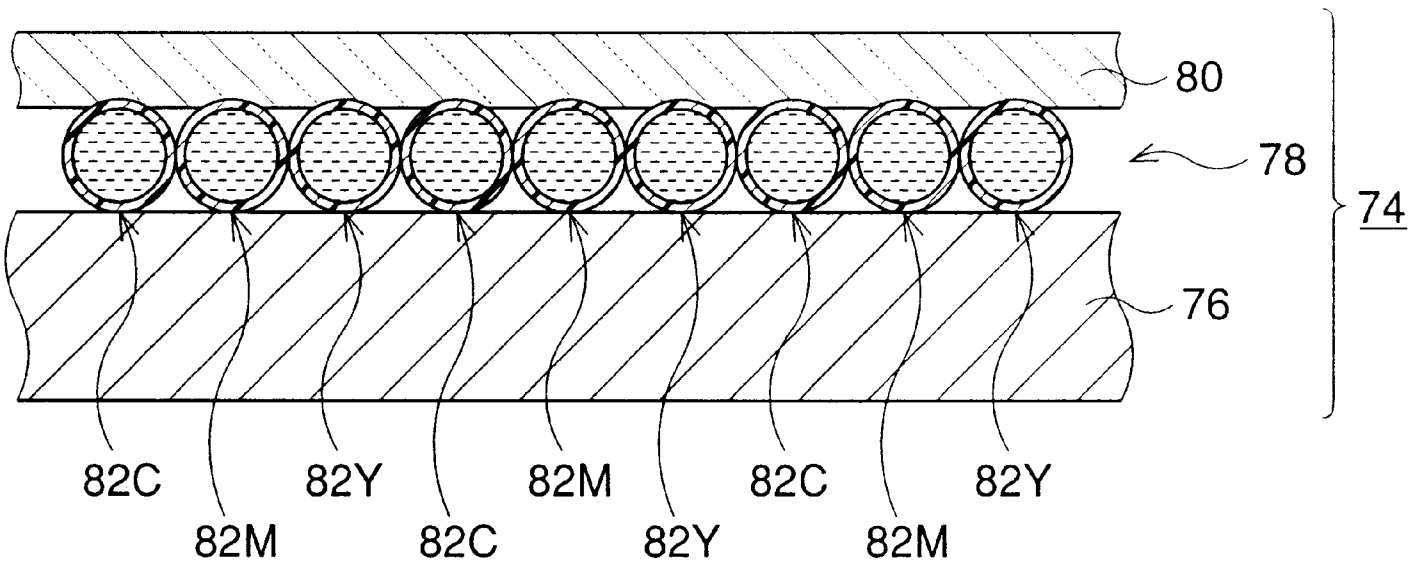
FIG. 18 is a schematic conceptual cross-sectional view showing another image-forming substrate, comprising a layer of microcapsules including a first type of cyan microcapsules filled with a cyan dye, a second type of magenta microcapsules filled with a magenta dye and a third type of yellow microcapsules filled with a yellow dye, used in a second embodiment of the image-forming system according to the present invention.

FIG. 18 shows another type of image-forming substrate, generally indicated by reference 74, which is used in a second embodiment of the image-forming system according to the present invention. The image-forming substrate 74 is similar in construction to the image-forming substrate 10 of FIG. 1. Namely, the image-forming substrate 74 comprises a sheet of paper 76, a layer of microcapsules 78 coated over a surface of the paper sheet 76, and a sheet of protective transparent film 80 covering the microcapsule layer 78. Also, similar to the image-forming substrate 10 of FIG. 1, the microcapsule layer 78 is formed from three types of microcapsules: a first type of microcapsules 82C filled with cyan liquid dye or ink, a second type of microcapsules 82M filled with magenta liquid dye or ink, and a third type of microcapsules 82Y filled with yellow liquid dye or ink, and these microcapsules 82C, 82M and 82Y are uniformly distributed in the microcapsule layer 78.

Figure 19:
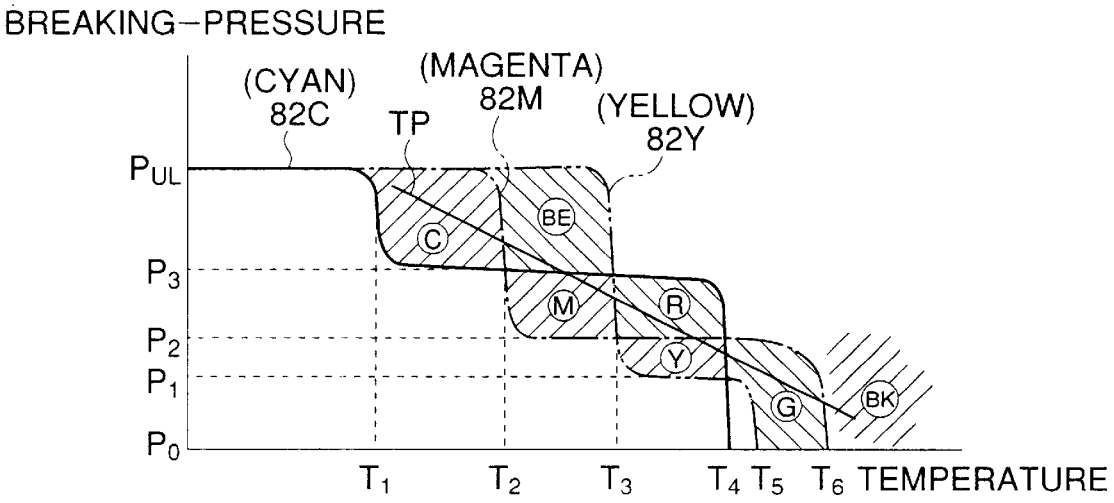
FIG. 19 is a graph showing pressure/temperature breaking characteristics of the respective cyan, magenta and yellow microcapsules shown in FIG. 18, with each of a cyan-developing area, a magenta-developing area, a yellow-developing area, a blue-developing area, a red-developing area, a green-developing area and a black-developing area being indicated as a hatched area.

In short, as shown in a graph of FIG. 19, the image-forming substrate 74 is different from the image-forming substrate 10 in that a shape memory resin of the cyan microcapsules 82C exhibits a characteristic longitudinal elasticity coefficient indicated by a solid line; a shape memory resin of the magenta microcapsules 82M exhibits a characteristic longitudinal elasticity coefficient indicated by a single-chained line; and a shape memory resin of the yellow microcapsules 82Y exhibits a characteristic longitudinal elasticity coefficient indicated by a double-chained line.

In particular, the shape memory resin of the cyan microcapsules 82C has a glass-transition temperature $T_1$, and loses a rubber elasticity when being heated to a temperature $T_4$, whereby the shape memory resin concerned is thermally fused or plastified. Also, the shape memory resin of the magenta microcapsules 82M has a glass-transition temperature $T_2$, and loses a rubber elasticity when being heated to a temperature $T_6$, whereby the shape memory resin concerned is thermally fused or plastified. Similarly, the shape memory resin of the yellow microcapsules 82Y has a glass-transition temperature $T_3$, and loses a rubber elasticity when being heated to a temperature $T_5$, whereby the shape memory resin concerned is thermally fused or plastified.

Also, as is apparent from the graph of FIG. 19, the shell wall of the cyan microcapsules 82C is broken and compacted under a breaking pressure that lies between a critical breaking pressure $P_3$ and an upper limit pressure $P_{UL}$ when each cyan microcapsule 82C is heated to a temperature between the glass-transition temperatures $T_1$ and $T_2$. Similarly, the shell wall of the magenta microcapsules 82M is broken and compacted under a breaking pressure that lies between a critical breaking pressure $P_2$ and the critical breaking pressure $P_3$, when each magenta microcapsule 82M is heated to a temperature between the glass-transition temperatures $T_2$ and $T_3$, and the shell wall of the yellow microcapsules 82Y is broken and compacted under a breaking pressure that lies between a critical breaking pressure $P_1$ and the critical breaking pressure $P_2$, when each yellow microcapsule 82Y is heated to a temperature between the glass-transition temperature $T_3$ and the plastifying temperature $T_4$.

Further, the shell walls of the cyan and magenta microcapsules 82C and 82M are broken and compacted under a breaking pressure that lies between the critical breaking pressure $P_3$ and the upper limit pressure $P_{UL}$, when the cyan and magenta microcapsules 82C and 82M are heated to a temperature between the glass-transition temperatures $T_2$ and $T_3$. The shell walls of the magenta and yellow microcapsules 82M and 82Y are broken and compacted under a breaking pressure that lies between the critical breaking pressures $P_2$ and $P_{31}$, when the magenta and yellow microcapsules 82M and 82Y are heated to a temperature between the glass-transition temperature $T_3$ and the plastifying temperature $T_4$. The shell walls of the cyan and yellow microcapsules 82C and 82Y are thermally fused or easily broken and compacted under a breaking pressure that lies between a critical pressure $P_0$ and the critical breaking pressure $P_1$, when the cyan and yellow microcapsules 82C and 82Y are heated to a temperature between the plastifying temperatures $T_5$ and $T_6$ of yellow and magenta, respectively. In addition, the shell walls of the cyan, magenta and yellow microcapsules 82C, 82M and 82Y are thermally fused or easily broken and compacted under a breaking pressure that lies between the critical breaking pressure $P_3$ and the upper limit pressure $P_{UL}$, when the cyan, magenta and yellow microcapsules 82C, 82M and 82Y are heated to at least the plastifying temperature $T_4$.

Accordingly, by suitably selecting a heating temperature and a breaking pressure, which should be exerted on the image-forming sheet 74, it is possible to selectively fuse and/or break the cyan, magenta and yellow microcapsules 82C, 82M and 82Y.

For example, if the selected heating temperature and breaking pressure fall within a hatched cyan-developing area C (FIG. 19), defined by a temperature ranging between the glass-transition temperatures $T_1$ and $T_2$ and by a pressure ranging between the critical breaking pressure $P_3$ and the upper limit pressure $P_{UL}$, only the cyan microcapsules 82C are compacted and broken, thereby producing cyan. If the selected heating temperature and breaking pressure fall within a hatched magenta-developing area M, defined by a temperature ranging between the glass-transition temperatures $T_2$ and $T_3$ and by a pressure ranging between the critical breaking pressures $P_2$ and $P_3$, only the magenta microcapsules 82M are compacted and broken, thereby producing magenta. If the selected heating temperature and breaking pressure fall within a hatched yellow-developing area Y, defined by a temperature ranging between the glass-transition temperature $T_3$ and the plastifying temperature $T_4$ and by a pressure ranging between the breaking pressures $P_1$ and $P_2$, only the yellow microcapsules 82Y are compacted and broken, thereby producing yellow.

Also, if the selected heating temperature and breaking pressure fall within a hatched blue-developing area BE, defined by a temperature ranging between the glass-transition temperatures $T_2$ and $T_3$ and by a pressure ranging between the critical breaking pressure $P_3$ and the upper limit pressure $P_{UL}$, the cyan and magenta microcapsules 82C and 82M are compacted and broken, thereby producing blue. If the selected heating temperature and breaking pressure fall within a hatched red-developing area R, defined by a temperature ranging between the glass-transition temperature $T_3$ and the plastifying temperature $T_4$ and by a pressure ranging between the breaking pressures $P_2$ and $P_3$, the magenta and yellow microcapsules 82M and 82Y are compacted and broken, thereby producing red. If the selected heating temperature and breaking pressure fall within a hatched green-developing area G, defined by a temperature ranging between the plastifying temperatures $T_5$ and $T_6$ and by a pressure ranging between the critical pressures $P_0$ and $P_2$, the cyan and yellow microcapsules 82C and 82Y are thermally fused or easily broken, thereby producing green. If the selected heating temperature and breaking pressure fall within a hatched black-developing area BK, generally defined by a temperature ranging between the plastifying temperatures $T_4$ and $T_6$ and by a pressure ranging between the critical pressure $P_3$ and the upper limit pressure $P_{UL}$, the cyan, magenta and yellow microcapsules 82C, 82M and 82Y are thermally fused and/or easily broken, thereby producing black.

Accordingly, if the selection of a heating temperature and a breaking pressure, which should be exerted on the image-forming sheet 74, is suitably controlled in accordance with digital color image-pixel signals: digital cyan image-pixel signals, digital magenta image-pixel signals and digital yellow image-pixel signals, it is possible to form a color image on the image-forming sheet 74 on the basis of the digital color image-pixel signals.

In the first embodiment of the image-forming system according to the present invention, it is necessary to execute three printing operations, before a single-line of color image can be obtained on the microcapsule layer 14 of the image-forming sheet 10. Namely, a cyan printing for developing cyan dots, a magenta printing for developing magenta dots and a yellow printing for developing yellow dots must be performed in accordance with a single-line of digital cyan image-pixel signals, a single-line of digital magenta image-pixel signals, and a single-line of digital yellow image-pixel signals.

Nevertheless, according to the second embodiment of the image-forming system, using the image-forming sheet 74, it is possible to form and print a single-line of color image on the microcapsule layer 78 of the image-forming sheet 74 at one time by using the line printer, as shown in FIGS. 6 and 7. Of course, to this end, the characteristic of each of the bimetal elements $R_n$ and the control circuit board 52 must be modified.

Figure 20:
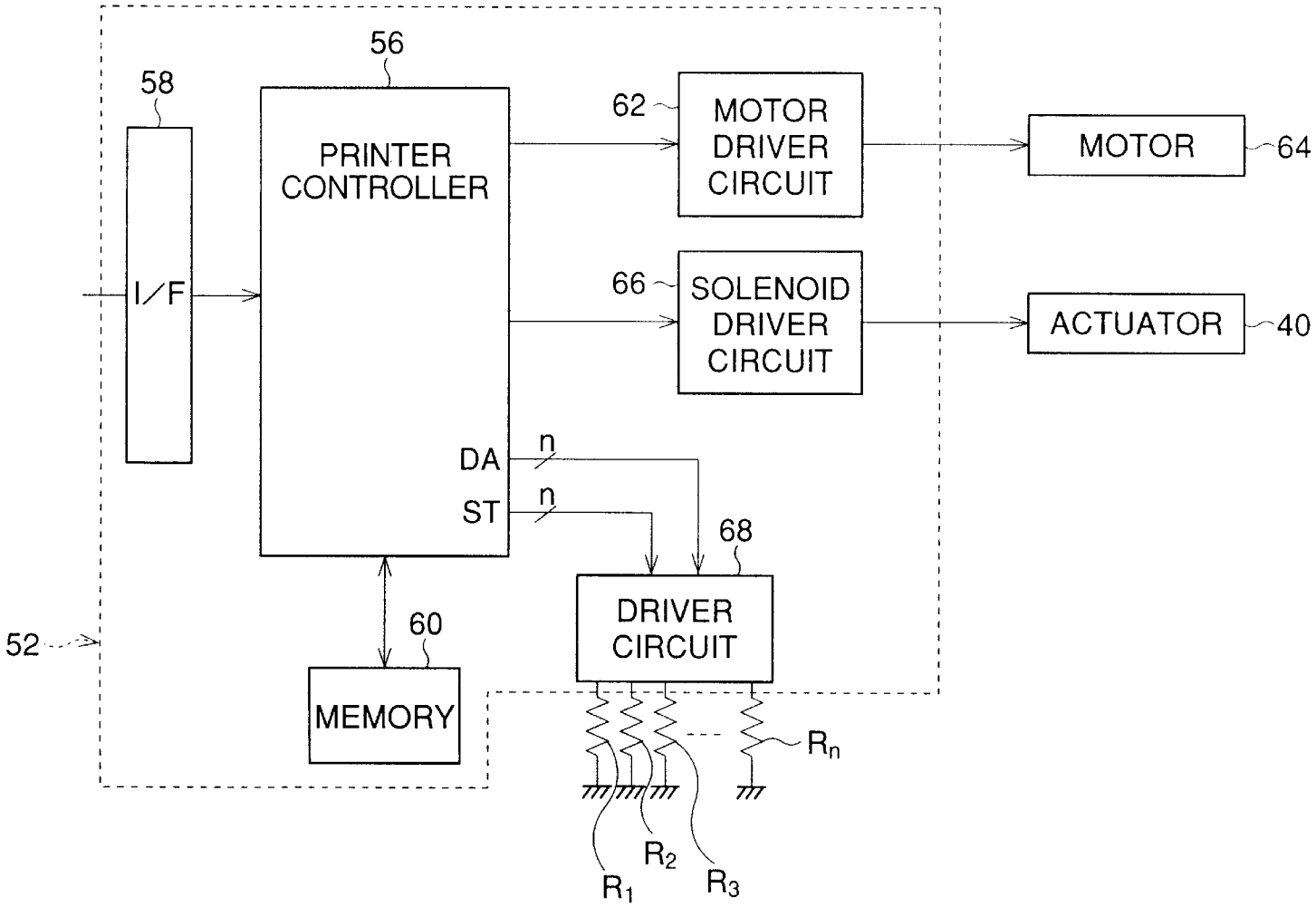
FIG. 20 is a modification of the schematic block diagram of FIG. 11, for forming a color image on a layer of microcapsules of the image-forming substrate shown in FIG. 18.

First, as shown in the graph of FIG. 19, each of the arcuate bimetal elements $R_n$ is modified so as to exhibit a pressure/temperature application characteristic linear curve TP, passing through all of the color-developing areas C, BE, M, R, Y, G and BK (FIG. 19). On the other hand, the control circuit board 52 is modified as shown in FIG. 20. Namely, the selective and electric energizations of the n arcuate bimetal elements $R_1$ to $R_n$ are controlled by n sets of strobe signals "ST" and control signals "DA", which are outputted from the printer controller 56 to the driver circuit 68.

Figure 21:
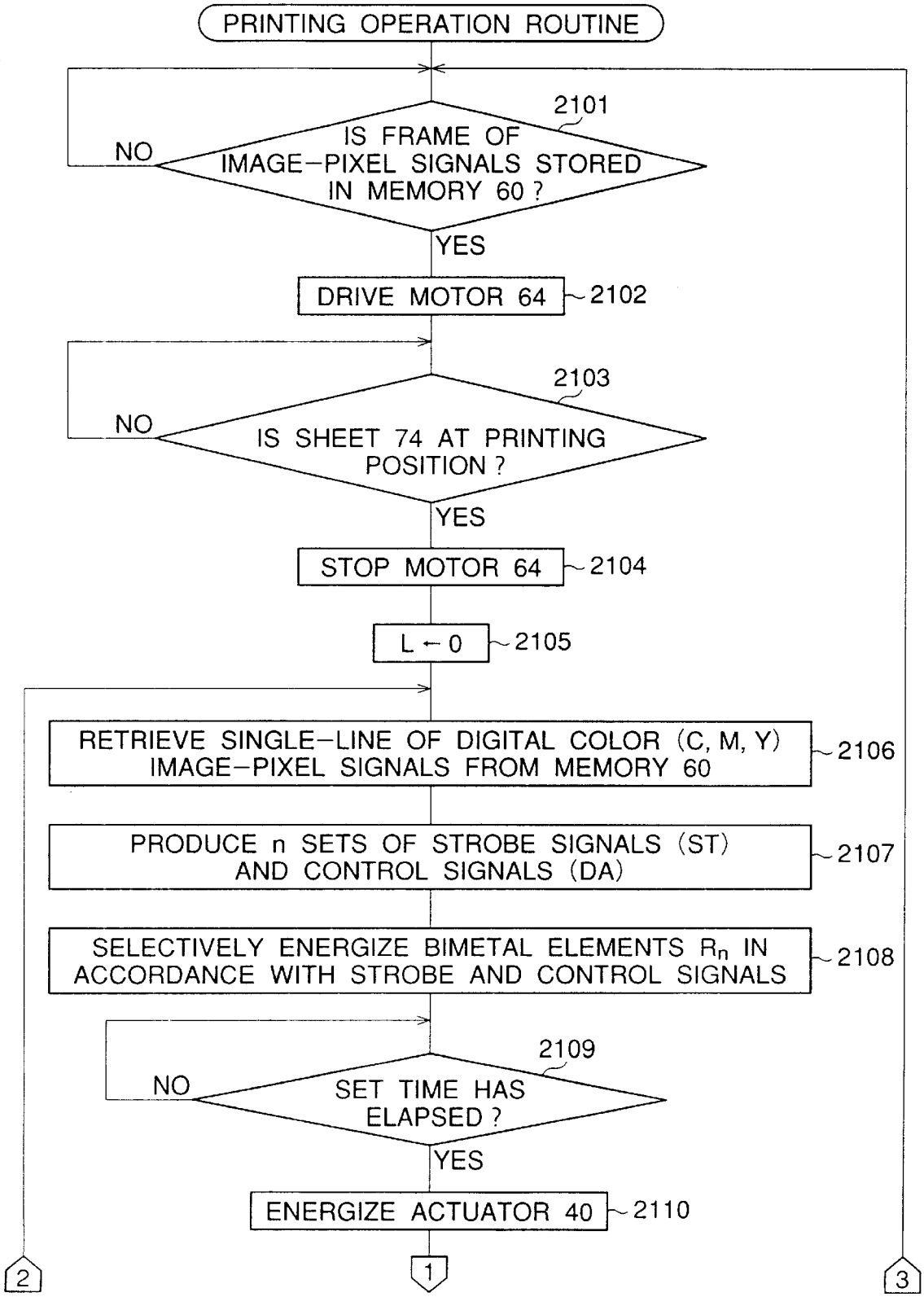
FIG. 21 shows a part of a flowchart of a printing operation routine executed in a printer controller in accordance with the second embodiment of the image-forming system of the present invention.
Figure 22:
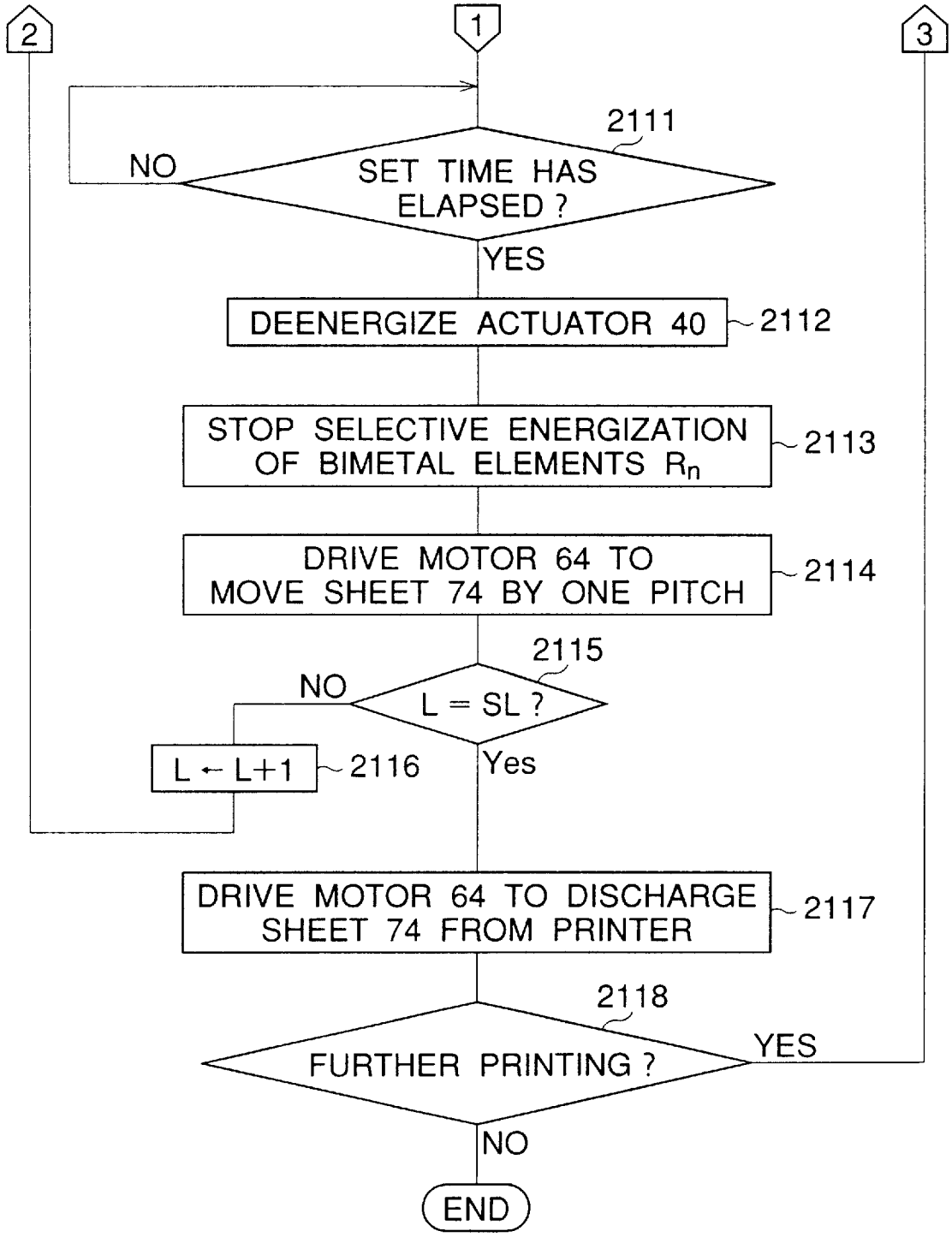
FIG. 22 shows the remaining part of the flowchart of the printing operation routine executed in the printer controller in accordance with the second embodiment of the image-forming system of the present invention.

With reference to FIGS. 21 and 22, showing a flowchart of a printing operation routine executed in the printer controller 52 in accordance with the second embodiment of the present invention, a printing operation will be now explained below.

At step 2101, it is determined whether a single-frame of color (cyan, magenta, yellow) image-pixel signals is stored in the memory 60. When the storage of the single-frame of color image-pixel signals in the memory 60 is confirmed, the control proceeds to step 2102, in which the electric motor 64 is driven so that an image-forming sheet 74 to be printed is moved toward an initial printing position.

At step 2103, it is determined whether the image-forming sheet 74 has reached the initial printing position, i.e. the image-forming sheet 74 is positioned at the printing position. When the positioning of the image-forming sheet 74 is confirmed, the control proceeds to step 2104, and the driving of the electric motor 64 is stopped. Then, at step 2105, the counter L is reset.

At step 2106, a first single-line of digital color (cyan, magenta, yellow) image-pixel image-pixel signals is retrieved from the memory 60 by the printer controller 56. Then, at step 2107, n sets of strobe signals "ST" and control signals "DA" are produced in accordance with the first single-line of digital color image-pixel signals. Namely, when a set of a strobe signal "ST" and a control signal "DA" is produced in accordance with a corresponding digital cyan image-pixel signal, a corresponding digital magenta image-pixel signal and a corresponding digital yellow image-pixel signal, the control signal "DA" varies in accordance with a combination of binary values of these color digital image-pixel signals, as shown in a TABLE in FIG. 23 and a timing chart in FIG. 24. Note, in the TABLE in FIG. 23, the respective cyan, magenta and yellow image-pixel signals are indicated by references "CS", "MS" and "YS".

Figure 24:
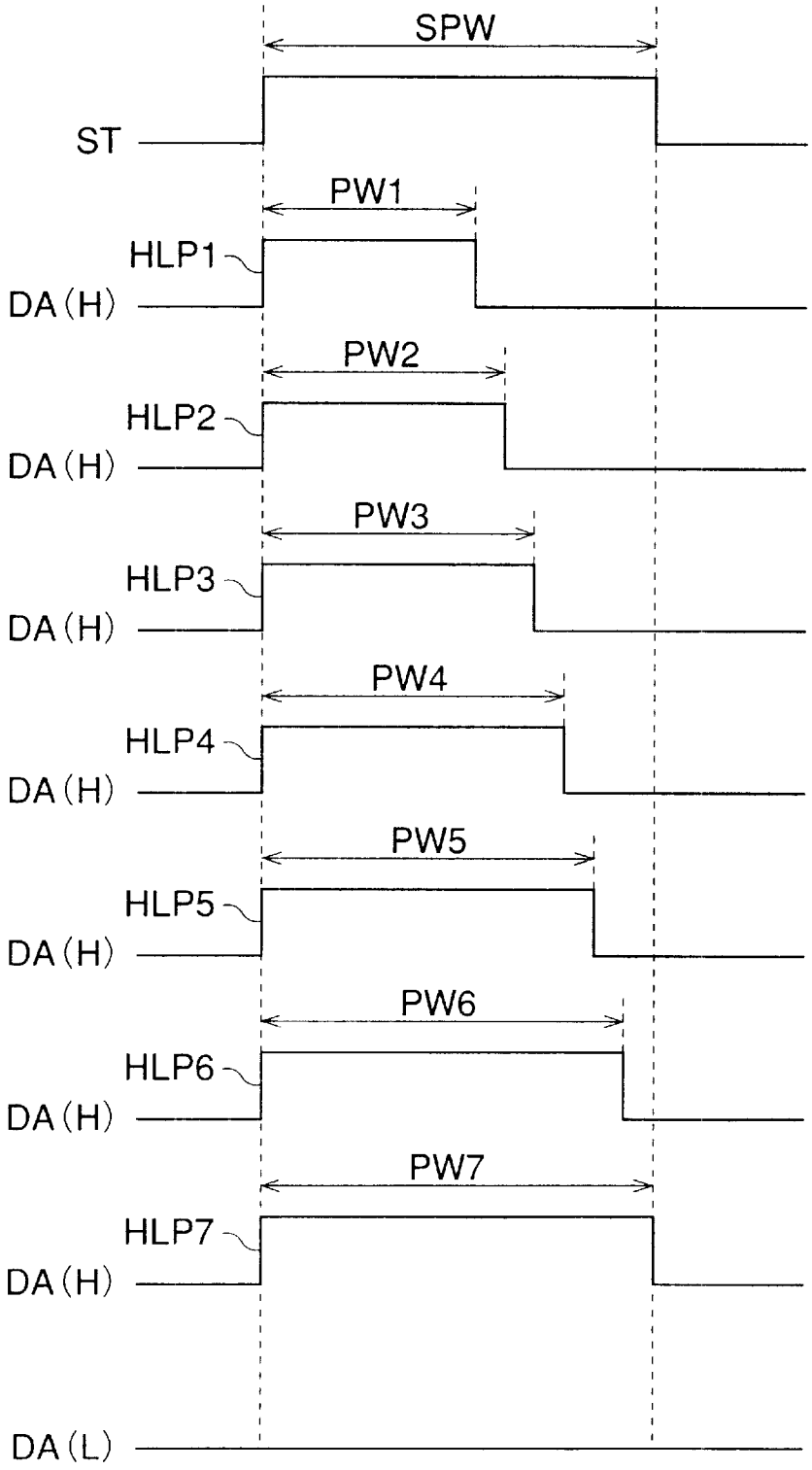
FIG. 24 is a timing chart showing a strobe signal and the control signal for electronically actuating the thermal head driver circuit.

In particular, as is apparent from FIGS. 23 and 24, when only the digital cyan image-pixel signal "CS" has a value "1", and when the remaining digital magenta and yellow image-pixel signals "MS" and "YS" have a value "0", the control signal "DA" is produced as a high-level pulse "HLP1" having a pulse width "PW1" shorter than a pulse width "SPW" of the strobe signal "ST". When the digital cyan and magenta image-pixel signals "CS" and "MS" have a value "1", and when the remaining yellow image-pixel signal "YS" has a value "0", the control signal "DA" is produced as a high-level pulse "HLP2" having a pulse width "PW2" longer than the pulse width "PW1" of the high-level pulse "HLP1". When only the digital magenta image-pixel signal "MS" has a value "1", and when the remaining cyan and yellow image-pixel signals "CS" and "YS" have a value "0", the control signal "DA" is produced as a high-level pulse "HLP3" having a pulse width "PW3" longer than the pulse width "PW2" of the high-level pulse "HLP2". When the digital magenta and yellow image-pixel signals "MS" and "YS" have a value "1", and when the remaining cyan image-pixel signal "CS" has a value "0", the control signal "DA" is produced as a high-level pulse "HLP4" having a pulse width "PW4". longer than the pulse width "PW3" of the high-level pulse "HLP3". When only the digital yellow image-pixel signal "YS" has a value "1", and when the remaining cyan and magenta image-pixel signals "CS" and "MS" have a value "0", the control signal "DA" is produced as a high-level pulse "HLP5" having a pulse width "PW5" longer than the pulse width "PW4" of the high-level pulse "HLP4". When the digital cyan and yellow image-pixel signals "CS" and "YS" have a value "1", and when the remaining magenta image-pixel signal "MS" has a value "0", the control signal "DA" is produced as a high-level pulse "HLP6" having a pulse width "PW6" longer than the pulse width "PW5" of the high-level pulse "HLP5". When the digital cyan, magenta and yellow image-pixel signals "CS", "MS" and "YS" all have a value "1", the control signal "DA" is produced as a high-level pulse "HLP7" having the same pulse width "PW7" as that of the pulse width "SPW" of the strobe signal "ST". When the digital cyan, magenta and yellow image-pixel signals "CS", "MS" and "YS" all have a value "0", the control signal "DA" is maintained at a low-level.

At step 2108, the n bimetal elements $R_n$ are selectively and electrically energized in accordance with the n sets of strobe signals "ST" and control signals "DA". In particular, when one of the n control signals "DA" is outputted as one of the high-level pulses "HLP1", "HLP2", "HLP3", "HLP4", "HLP5", "HLP6", or "HLP7", a corresponding transistor (72) is switched ON during a period corresponding to the corresponding pulse width ("PW1", "PW2", "PW3", "PW4", "PW5", "PW6" or "PW7"), so that a corresponding bimetal element ($R_n$) is electrically energized. By the energization of the bimetal element ($R_n$) during the period corresponding to the pulse width "PW1", the bimetal element ($R_n$) concerned is heated to within the temperature range defined by the cyan-developing area C. By the energization of the bimetal element ($R_n$) during the period corresponding to the pulse width "PW2", the bimetal element ($R_n$) concerned is heated to within the temperature range defined by the blue-developing area BE. By the energization of the bimetal element ($R_n$) during the period corresponding to the pulse width "PW3", the bimetal element ($R_n$) concerned is heated to within the temperature range defined by the magenta-developing area M. By the energization of the bimetal element ($R_n$) during the period corresponding to the pulse width "PW4", the bimetal element ($R_n$) concerned is heated to within the temperature range defined by the red-developing area R. By the energization of the bimetal element ($R_n$) during the period corresponding to the pulse width "PW5", the bimetal element ($R_n$) concerned is heated to within the temperature range defined by the yellow-developing area Y. By the energization of the bimetal element ($R_n$) during the period corresponding to the pulse width "PW6", the bimetal element ($R_n$) concerned is heated to within the temperature range defined by the green-developing area G. By the energization of the bimetal element ($R_n$) during the period corresponding to the pulse width "PW7", the bimetal element concerned is heated to within the temperature range defined by the black-developing area BK. Note, when one of the control signals "DA" is maintained at a low-level, a corresponding transistor (72) is switched OFF, so that a corresponding bimetal element ($R_n$) is not electrically energized.

At step 2109, it is determined whether a predetermined very short time has elapsed such that the electrically-energized bimetal elements ($R_n$) are heated to within the temperature ranges defined by the color-developing areas (C, BE, M, R, Y G and BK). After the predetermined set time has elapsed, the control proceeds to step 2110, in which the solenoid actuator 40 is electrically energized by the solenoid driver circuit 66 so that the thermal head assembly 34 is rotated from the non-printing position to the printing position, whereby the heated bimetal elements ($R_n$) develop color (cyan, blue, magenta, red, yellow, green and black) dots along a first single-line on the microcapsule layer 78 of the image-forming sheet 74.

At step 2111, it is determined whether a predetermined very short time has elapsed, such that the development of the cyan dots can be surely carried out. After the predetermined set time has elapsed, the control proceeds to step 2112, in which the solenoid actuator 40 is deenergized by the solenoid driver circuit 66 so that the thermal head assembly 34 is rotated from the printing position to the non-printing position. Then, at step 2113, the selective energization of the bimetal elements $R_n$ is stopped.

At step 2114, the electric motor 64 is driven such that the image-forming sheet 74 is moved by one pitch, being one line. Then, at step 2115, it is determined whether the a count number of the counter L is equal to "SL", which represents a sum of single-lines of color image-pixel signals corresponding to a frame of digital color image-pixels. When L<SL, the control proceeds to step 2116, in which the count number of the counter L is incremented by "1", and then the control returns to step 2106. Namely, a line-by-line color printing, as mentioned above, is repeated in accordance with the consecutive single-lines of digital color image-pixel signals until the count number of the counter L reaches "SL".

At step 2115, when the count number L has reached "SL", i.e. when all of the line-by-line color printings are completed, the control proceeds to step 2117, in which the electric motor 64 is driven so that the image-forming sheet 74 carrying the printed color image is discharged from the printer. Then, it is determined whether a further printing operation should be performed. If a further printing operation is to be performed, the control returns to step 2101. If the further printing operation is not to be performed, this routine ends.

For an ink to be encapsulated in the microcapsules, leuco-pigment may be utilized. In general, the leuco-pigment per se exhibits no pigmentation, i.e. colorless or transparent, and does not develop a given monochromatic color until it chemically reacts with a color developer. Accordingly, in this case, the color developer is contained in the binder, which forms a part of the layer of microcapsules (14, 78).

Although the above-mentioned embodiments are directed to a formation of a color image, the present invention may be applied to a formation of a monochromatic image. In this case, a layer of microcapsules (14, 78) is composed of only one type of microcapsule filled with, for example, a black ink.

Finally, it will be understood by those skilled in the art that the foregoing description is of preferred embodiments of the system, and that various changes and modifications may be made to the present invention without departing from the spirit and scope thereof.

The present disclosure relates to a subject matter contained in Japanese Patent Application No. 10-15139 (filed on Jan. 9, 1998) which is expressly incorporated herein, by reference, in its entirety.

What is claimed is:

1. An image-forming system comprising:

an image-forming substrate that includes a base member, and a layer of microcapsules, coated over said base member, containing at least one type of microcapsule filled with a dye;

said at least one type microcapsule exhibiting a pressure/temperature characteristic such that, when each of said microcapsules is squashed and broken under a predetermined pressure at a predetermined temperature, said dye seeps from said squashed and broken microcapsule; and a pressure/temperature application unit that includes a platen member, a thermal head assembly having at least one arcuate bimetal element associated with said platen member such that said image-forming substrate is interposeable between said platen member and said thermal head assembly, and an electrical energization system that electrically heats said at lease one arcuate bimetal element in accordance with image-information data, a degree of protrusion of said at least one arcuate bimetal element varying in accordance with said electrical heating of said at least one arcuate bimetal element such that a pressure, exerted on said platen member by said at least one arcuate bimetal element, substantially equals said predetermined pressure when said at least one arcuate bimetal element is heated to said predetermined temperature.

2. An image-forming system as set forth in claim 1, wherein said at least one arcuate bimetal element is constituted such that said degree of protrusion of said at least one arcuate bimetal element gradually reduces as said electrical heating of said at least one arcuate bimetal element increases.

3. An image-forming system as set forth in claim 1, wherein said thermal head assembly is movable between a first position at which said at least one arcuate bimetal element exerts substantially a negligible pressure on said platen member, and a second position at which said at least one arcuate bimetal element exerts a pressure on said platen member, said thermal head assembly being moved from said first position to said second position after said electrical heating of said at least one arcuate bimetal element to said predetermined temperature.

4. An image-forming system as set forth in claim 1, wherein said thermal head assembly has a plurality of arcuate bimetal elements aligned with each other in a single array, and said platen member is formed as a rotatable roller platen arranged in parallel to said single array of arcuate bimetal elements.

5. An image-forming system as set forth in claim 4, wherein said plurality of arcuate bimetal elements is selectively and electrically heated by said electrical energization system in accordance with a single-line of said image-information data.

6. An image-forming system comprising:

an image-forming substrate that includes a base member, and a layer of microcapsules, coated over said base member, containing at least two types of microcapsule: a first type of microcapsule filled with a first dye and a second type of microcapsule filled with a second dye;

said first type of microcapsule exhibiting a first pressure/temperature characteristic such that, when said first type of microcapsule is squashed and broken under a first predetermined pressure at a first predetermined temperature, said first dye seeps from said squashed and broken microcapsule;

said second type of microcapsule exhibiting a second pressure/temperature characteristic such that, when said second type of microcapsule is squashed and broken under a second predetermined pressure at a second predetermined temperature, said second dye seeps from said squashed and broken microcapsule; and a pressure/temperature application unit that includes a platen member, a thermal head assembly having at least one arcuate bimetal element associated with said platen member such that said image-forming substrate is interposeable between said platen member and said thermal head assembly, and an electrical energization system that electrically heats said at least one arcuate bimetal element in accordance with image-information data, a degree of protrusion of said at least one arcuate bimetal element varying in accordance with said electrical heating of said at least one arcuate bimetal element such that a pressure, exerted on said platen member by said at least one arcuate bimetal element, substantially equals one of said first and second predetermined pressures when said at least one arcuate bimetal element is heated to a corresponding one of said first and second predetermined temperatures.

7. An image-forming system as set forth in claim 6, wherein said at least one arcuate bimetal element is constituted such that said degree of protrusion of said at least one arcuate bimetal element gradually reduces as said electrical heating of said at least one arcuate bimetal element increases.

8. An image-forming system as set forth in claim 6, wherein said thermal head assembly is movable between a first position at which said at least one arcuate bimetal element exerts substantially a negligible pressure on said platen member, and a second position at which said at least one arcuate bimetal element exerts a pressure on said platen member, said thermal head assembly being moved from said first position to said second position after said electrical heating of said at least one arcuate bimetal element to one of said first and second predetermined temperatures.

9. An image-forming system as set forth in claim 6, wherein said thermal head assembly has a plurality of arcuate bimetal elements aligned with each other in a single array, and said platen member is formed as a rotatable roller platen arranged in parallel to said single array of arcuate bimetal elements.

10. An image-forming system as set forth in claim 9, wherein said plurality of arcuate bimetal elements is selectively and electrically heated by said electrical energization system in accordance with a single-line of said image-information data.

11. An image-forming apparatus that forms an image on an image-forming substrate that includes a base member, and a layer of microcapsules, coated over said base member, that contains at least one type of microcapsule filled with a dye, said at least one type of microcapsule exhibiting a pressure/temperature characteristic such that, when said at least one type of microcapsule is squashed and broken under a predetermined pressure at a predetermined temperature, said dye seeps from said squashed and broken microcapsule, said image-forming apparatus comprising:

a platen member;

a thermal head assembly having at least one arcuate bimetal element and associated with said platen member such that said image-forming substrate is interposeable between said platen member and said thermal head assembly; and an electrical energization system that electrically heats said at least one arcuate bimetal element in accordance with image-information data, a degree of protrusion of said at least one arcuate bimetal element varying in accordance with said electrical heating of said at least one arcuate bimetal element such that a pressure, exerted on said platen member by said at least one arcuate bimetal element, substantially equals said predetermined pressure when said at least one arcuate bimetal element is heated to said predetermined temperature.

12. An image-forming system as set forth in claim 11, wherein said at least one arcuate bimetal element is constituted such that said degree of protrusion of said at least one arcuate bimetal element gradually reduces as said electrical heating of said at least one arcuate bimetal element increases.

13. An image-forming system as set forth in claim 11, wherein said thermal head assembly is movable between a first position at which said at least one arcuate bimetal element exerts substantially a negligible pressure on said platen member, and a second position at which said at least one arcuate bimetal element exerts a pressure on said platen member, said thermal head assembly being moved from said first position to said second position after said electrical heating of said at least one arcuate bimetal element to said predetermined temperature.

14. An image-forming system as set forth in claim 11, wherein said thermal head assembly has a plurality of arcuate bimetal elements aligned with each other in a single array, and said platen member is formed as a rotatable roller platen arranged in parallel to said single array of arcuate bimetal elements.

15. An image-forming system as set forth in claim 14, wherein said plurality of arcuate bimetal elements is selectively and electrically heated by said electrical energization system in accordance with a single-line of said image-information data.

* * * * *